US010597121B2

(12) United States Patent
Morgan et al.

(10) Patent No.: US 10,597,121 B2
(45) Date of Patent: Mar. 24, 2020

(54) SUPPORT STRUCTURE

(71) Applicant: BOMBARDIER RECREATIONAL PRODUCTS INC., Valcourt (CA)

(72) Inventors: Garrett Morgan, Sherbrooke (CA); Marc-Etienne Bessette, Saint-Alphonse-de-Granby (CA); Richard Simard, Drummondville (CA); Simon Erpelding, Racine (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 0 days.

(21) Appl. No.: 15/987,690

(22) Filed: May 23, 2018

(65) Prior Publication Data

US 2018/0346075 A1 Dec. 6, 2018

Related U.S. Application Data

(60) Provisional application No. 62/512,866, filed on May 31, 2017.

(51) Int. Cl.

| | |
|---|---|
| ***B63B 35/73*** | (2006.01) |
| ***B63B 21/56*** | (2006.01) |
| ***B63B 35/81*** | (2006.01) |

(52) U.S. Cl.

CPC ..... *B63B 21/56* (2013.01); *B63B 35/731* (2013.01); *B63B 35/816* (2013.01); *B63B 2035/735* (2013.01)

(58) Field of Classification Search

CPC ..... B63B 21/56; B63B 2021/56; B63B 35/73; B63B 35/731; B63B 2035/73; B63B 2035/735

USPC ..... 114/242, 249, 253, 55.5, 55.57

See application file for complete search history.

(56) References Cited

U.S. PATENT DOCUMENTS 5,501,168 A * 3/1996 Zachary ..... B63B 35/731 114/363
5,570,654 A * 11/1996 Rood ..... B63B 29/00 114/363
5,586,922 A * 12/1996 Kobayashi ..... B63B 35/731 114/55.5

(Continued)

OTHER PUBLICATIONS

Bombardier Recreational Products Inc. 2003-2015; [online], [retrieved on Feb. 9, 2015]. Retrieved from the Internet <URL: http://store.sea-doo.com/product/0/295100457/_/Retractable_Ski_Pylon?_ga=1.110025285.1590955954.1423076350>.

*Primary Examiner* — Daniel V Venne
(74) *Attorney, Agent, or Firm* — BCF LLP

(57) ABSTRACT

A support structure for mounting an accessory assembly to a vehicle having a mounting surface defining a base mount and at least one brace mount includes a base having a connection portion being selectively connectable to the vehicle, and a support portion. The base is connectable to the accessory assembly. The support structure further includes a brace having a mating portion for engaging the support portion, and at least one arm extending from the mating portion toward the connection portion and away from the base when the mating portion engages the support portion. The at least one arm has a proximal end connected to the mating portion, and a distal end being spaced from the connection portion and being selectively engageable to the vehicle. The support structure further includes a lock selectively locking the mating portion to the base.

20 Claims, 20 Drawing Sheets

(56) References Cited

U.S. PATENT DOCUMENTS

| | | | | |
|---|---|---|---|---|
| 5,934,217 | A | 8/1999 | Allsop | |
| 5,943,977 | A | 8/1999 | Womack et al. | |
| 6,021,734 | A | 2/2000 | Sperberg | |
| RE37,823 | E | 9/2002 | Larson et al. | |
| 6,575,112 | B2 | 6/2003 | Roeseler et al. | |
| 6,792,888 | B1 | 9/2004 | Metcalf | |
| 6,865,999 | B2 | 3/2005 | Bierbower, Jr. | |
| 6,886,488 | B2 | 5/2005 | Berthiaume et al. | |
| 6,986,321 | B2 | 1/2006 | Metcalf | |
| 6,994,396 | B2 * | 2/2006 | Burleson | B62J 1/12 114/362 |
| 6,997,131 | B2 | 2/2006 | Jackson et al. | |
| 7,128,014 | B2 | 10/2006 | Berthiaume et al. | |
| 7,219,617 | B2 | 5/2007 | Metcalf | |
| 7,263,944 | B1 | 9/2007 | Smith | |
| 7,357,090 | B2 * | 4/2008 | Spade | B63B 35/731 114/55.52 |
| 7,370,599 | B1 | 5/2008 | Berman et al. | |
| 8,196,542 | B2 | 6/2012 | Oswell et al. | |
| 8,777,531 | B2 | 7/2014 | Massicotte et al. | |
| 8,875,830 | B2 | 11/2014 | Massicotte et al. | |
| 9,505,335 | B2 | 11/2016 | Massicotte et al. | |
| 9,511,704 | B2 | 12/2016 | Massicotte et al. | |
| 9,731,797 | B2 | 8/2017 | Paccoud et al. | |
| 2015/0210355 | A1 | 7/2015 | Labbe et al. | |
| 2016/0221650 | A1 | 8/2016 | Paccoud et al. | |
| 2017/0174145 | A1 | 6/2017 | Labbe et al. | |

* cited by examiner

SUPPORT STRUCTURE

CROSS-REFERENCE TO RELATED APPLICATION

The present application claims priority to U.S. Provisional Patent Application Ser. No. 62/512,866, filed May 31, 2017, entitled "Support Structure", which is incorporated by reference herein in its entirety.

FIELD OF THE TECHNOLOGY

The present technology relates to support structures. More particularly, the present technology relates to a support structure for mounting an accessory assembly to a vehicle.

BACKGROUND

Recreational vehicles, such as all-terrain vehicles (ATVs), side-by-side vehicles (SSVs), snowmobiles and personal watercrafts, are commonly used with different accessory assemblies to satisfy a user's needs and desires. For example, a cargo box can be mounted to a bed or on a hood of a SSV. In another example, an extendable and stowable tow pylon assembly can be mounted to the deck of a personal watercraft to raise the point where the tow rope is attached to the watercraft and to provide an additional handle for a rear-facing passenger acting as a spotter for a skier, tuber or the like.

Such accessory assemblies are most often mounted to the recreational vehicle using a support structure that is in turn mounted to a mounting surface of the recreational vehicle using fasteners, such as screws, bolts and nuts. While some accessory assemblies may be removed, collapsed, folded or stowed when not in use, it may be desirable in some situations to completely remove an accessory assembly and its support structure from the recreational vehicle. However, the removal of the support structure generally involves undoing the fasteners, which is generally time-consuming and requires the use of tools. In addition, it can be required to disassemble portions of the vehicle and/or access to the underside of the vehicle's mounting surface to which the support structure is mounted to undo the fasteners. The removal of the support structure can also leave brackets, bases, fastener portions and the like along the vehicle's mounting surface after removal of the support structure therefrom, which can be undesirable, especially in watercraft.

Therefore, there is a desire for a conveniently removable support structure that leaves the vehicle's mounting surface free of encumbrances when the support structure is removed therefrom.

SUMMARY

It is an object of the present technology to ameliorate at least some of the inconveniences present in the prior art.

According to one aspect of the present technology, there is provided a support structure for mounting an accessory assembly to a vehicle. The support structure includes a base adapted for being connected to the accessory assembly. The base includes a connection portion being selectively connectable to the vehicle, and a support portion. The support structure further includes a brace including a mating portion for engaging the support portion of the base and at least one arm extending from the mating portion toward the connection portion of the base. The at least one arm extends away from the base when the mating portion engages the support portion of the base. The at least one arm has a proximal end connected to the mating portion, and a distal end being spaced from the connection portion of the base and being selectively engageable to the vehicle. The support structure also includes a lock selectively locking the mating portion to the support portion of the base.

In some implementations, the base defines a receptacle extending at least partially through the support portion for receiving at least a portion of the accessory assembly therein.

In some implementations, the receptacle is a through hole extending through the support portion and the connection portion of the base.

In some implementations, the base further includes a flange disposed between the connection and support portions. The flange extends outwardly from the base.

In some implementations, the support structure further has a seal connected to a face of the flange facing toward the connection portion of the base.

In some implementations, the connection portion of the base has angularly-spaced projections extending outwardly from the connection portion.

In some implementations, the distal end of the at least one arm has a skewed portion extending away from the base.

In some implementations, the at least one arm is integral with the mating portion.

In some implementations, the at least one arm is two arms, and the distal ends of the two arms are spaced apart from each other.

In some implementations, the two arms and the mating portion form a V-shape.

In some implementations, the support structure further includes a flexible elongate member connected between the brace and the base.

In some implementations, the brace includes the lock, and the lock is mounted to the mating portion of the brace.

In some implementations, the lock is a manually operable lock.

According to another aspect of the present technology, there is provided an accessory mounting assembly. The accessory mounting assembly has a support structure including a base having a connection portion and a support portion, a brace including a mating portion for engaging the support portion of the base, and at least one arm extending from the mating portion toward the connection portion of the base. The at least one arm extends away from the base when the mating portion engages the support portion of the base. The at least one arm has a proximal end connected to the mating portion, and a distal end being spaced from the connection portion of the base. The support structure also includes a lock selectively locking the mating portion to the support portion of the base. The accessory mounting assembly further has an accessory assembly including a mounting member being connected to the base.

In some implementations, the base defines a receptacle extending at least partially through the support portion, and the mounting member is received in the receptacle.

In some implementations, the accessory assembly is a tow pylon assembly having a pylon, and the mounting member is the pylon.

In some implementations, the pylon is slidably received in the receptacle between a stowed position and an extended position.

In some implementations, the base further includes a resilient latch assembly. The resilient latch assembly includes a latch selectively extending at least partially in the receptacle. The pylon has a recess defined on an outer face thereof, and the latch resiliently engages the recess when the pylon is in the extended position.

In some implementations, the brace includes the lock and the lock is mounted to the mating portion of the brace.

In some implementations, the lock is a manually operable lock.

According to yet another aspect of the present technology, there is provided a vehicle including a mounting surface defining a base mount and at least one brace mount, and a support structure selectively connected to the mounting surface for mounting an accessory assembly to the vehicle. The support structure includes a base for connecting the accessory assembly and being selectively connected to the base mount. The support structure further includes a brace having a mating portion being spaced from the mounting surface, and at least one arm extending away from the mating portion toward the mounting surface. The at least one arm has a proximal end connected to the mating portion, and a distal end being spaced from the base and being selectively engaged to the at least one brace mount. The support structure further includes a lock selectively locking the mating portion to the base.

In some implementations, the base mount defines an aperture.

In some implementations, the aperture is bound by a cylindrical wall extending vertically from the mounting surface, and a connection portion of the base is received within the aperture and the cylindrical wall of the base mount.

In some implementations, a periphery of the aperture defines a top of one of a base mount recess and a base mount through hole.

In some implementations, the vehicle further includes a cap covering the aperture of the base mount when the support structure is disconnected from the vehicle.

In some implementations, the at least one brace mount is one of at least one brace mount recess, and at least one brace mount through hole.

In some implementations, the brace mount has a top surface extending below the mounting surface, and the brace mount defines a space extending at least partially under the top surface.

In some implementations, the distal end of the at least one arm has a skewed portion that extends in the space below a portion of the mounting surface adjacent to the at least one brace mount, and under the top surface of the brace mount.

In some implementations, the base mount and the base include complementary angularly-spaced projections and angularly-spaced recesses for selectively connecting the base to the mounting surface upon rotation of the base with respect to the base mount.

In some implementations, the at least one brace mount is two brace mounts defined on the mounting surface forward and on either side of a center of the base mount. The at least one arm is two arms extending forwardly from the mating portion and on either side of a center of the base. The distal end of each of the two arms includes a skewed portion that is selectively engaged with a corresponding one of the two brace mounts.

In some implementations, the brace includes the lock and the lock is mounted to the mating portion of the brace.

In some implementations, the lock is a manually operable lock.

In some implementations, the vehicle is a personal watercraft including a deck having longitudinal centerline. The deck defines the mounting surface. The base mount is defined along the longitudinal centerline. The at least one brace mount is two brace mounts defined on the deck forward of the base mount and on either side of the longitudinal centerline. The at least one arm is two arms extending on either side of the longitudinal centerline and forward of the base. The distal end of each of the two arms is selectively engaged with a corresponding one of the two brace mounts.

In some implementations, the deck defines a pedestal, the personal watercraft further includes a straddle-type seat disposed on the pedestal, and the two brace mounts are defined on the pedestal.

In some implementations, the vehicle further includes an accessory assembly mounted to the support structure.

In some implementations, the base defines a receptacle, and the accessory assembly is a tow pylon assembly including a pylon being slidably received in the receptacle between a stowed position and an extended position.

In some implementations, the base mount is a through hole, and a lower portion of the pylon extends at least partially through the base mount when the pylon is in the stowed position.

In some implementations, the tow pylon assembly includes at least one handle connected to an upper portion of the pylon. The at least one handle is configured to be held by a passenger of the vehicle when the pylon is in the extended position.

In some implementations, the tow pylon assembly includes a bollard connected to an upper portion of the pylon. The bollard is configured for attaching a tow rope to the pylon.

For purposes of this application, terms related to spatial orientation such as forwardly, rearward, upwardly, downwardly, left, and right, are as they would normally be understood by an operator of the vehicle sitting thereon in a normal riding position. Terms related to spatial orientation when describing or referring to components or sub-assemblies of the vehicle, separately from the vehicle, such as a deck or hull for example, should be understood as they would be understood when these components or sub-assemblies are mounted to the vehicle, unless specified otherwise in this application. The term "straddle-type seat" refers to a seat on which a person normally sits astride.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein. The explanations provided above regarding the above terms take precedence over explanations of these terms that may be found in any one of the documents incorporated herein by reference.

Additional and/or alternative features, aspects and advantages of implementations of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
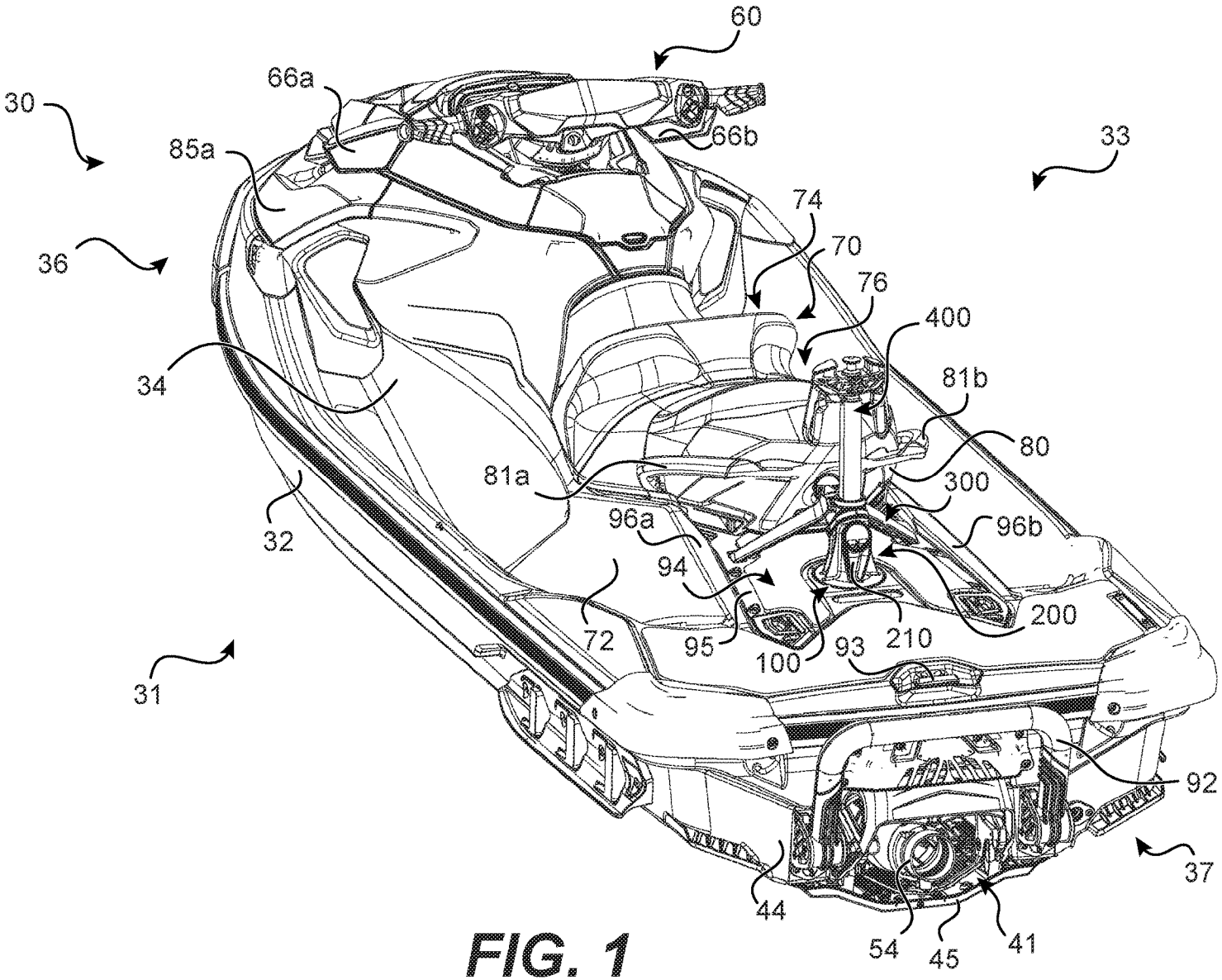
FIG. 1 is a top, left, rear side perspective view of a personal watercraft having a support structure for mounting a tow pylon assembly to the personal watercraft, with a pylon of the tow pylon assembly in an extended position.

With reference to the accompanying Figures, the present detailed description is intended to be a description of a support structure for mounting an accessory to a vehicle in accordance with an implementation of the present technology. Although the support structure described herein is mountable to a personal watercraft, the support structure and aspects thereof could be used on a variety of vehicles, such as all-terrain vehicles (ATVs), side-by-side vehicle (SSVs) and snowmobiles.

Referring to FIGS. 1 to 7, a general description of an implementation of a personal watercraft 30 is provided. The personal watercraft 30 has a hull 32 and a deck 34. The hull 32 and the deck 34 are made of fiberglass composite material. It is contemplated that other suitable materials could be used to make the hull 32 and the deck 34. The hull 32 buoyantly supports the watercraft 30 in the water. The hull 32 has a bow 36 and a stern 37. A longitudinal centerline 39 (FIG. 5) extends between the bow 36 and the stern 37 and splits the deck 34 into a left longitudinal side 31 and a right longitudinal side 33. For the purpose of the following description, the components that are qualified as "left" are positioned on the corresponding left longitudinal side 31 of the personal watercraft 30 and have reference numerals with the suffix "a", and the components that are qualified as "right" are positioned on the corresponding right longitudinal side 33 of the personal watercraft 30 and have reference numerals with the suffix "b", unless mentioned otherwise. The deck 34 is designed to accommodate an operator and two passengers, collectively referred to as riders. It is contemplated that the deck 34 could be designed to accommodate just one passenger, no passengers or more than two passengers.

Figure 6:
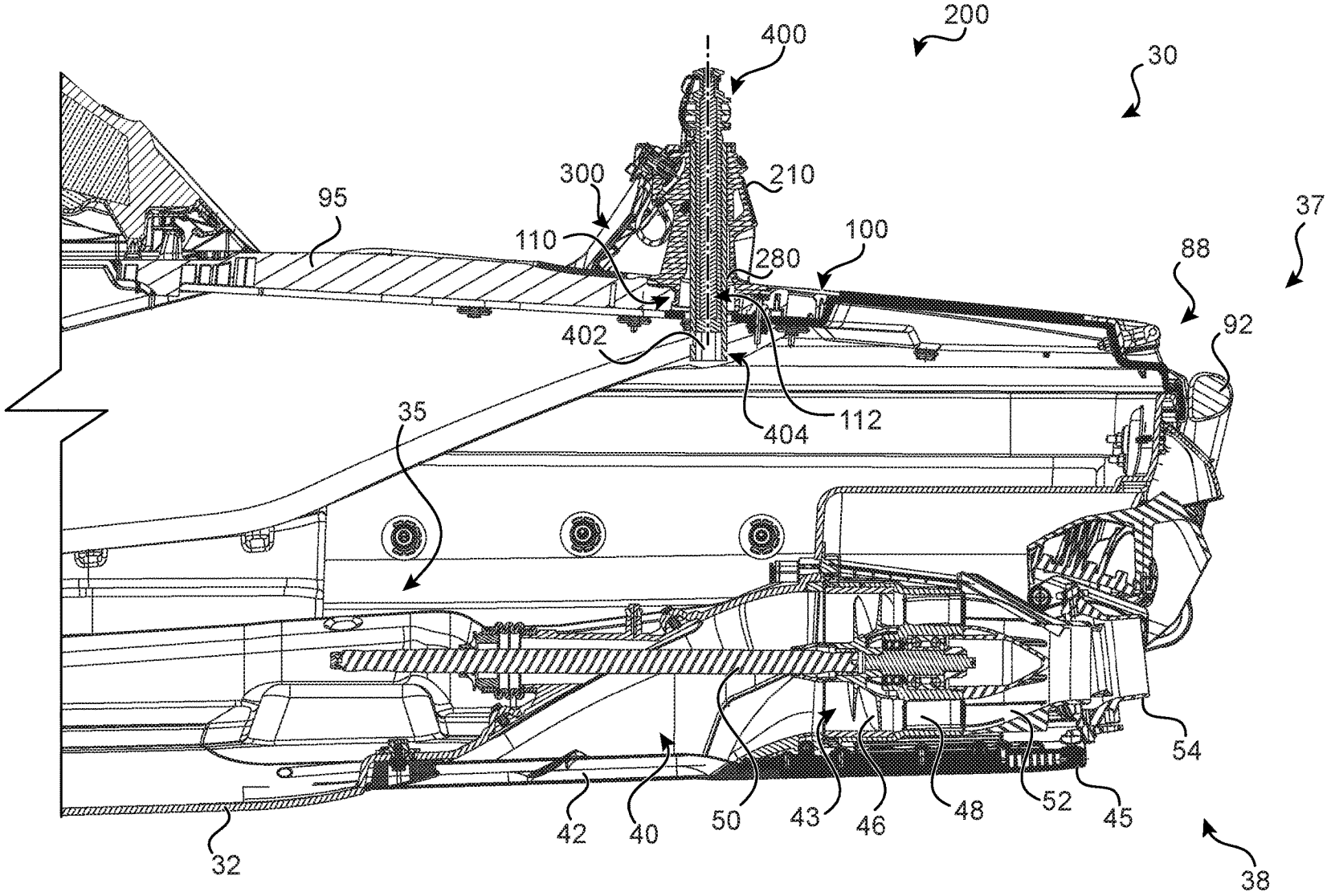
FIG. 6 is a cross-sectional view of the personal watercraft of FIG. 4 taken along cross-section line 6-6 of FIG. 5.

The space between the hull 32 and the deck 34 forms a volume commonly referred to as the motor compartment 35 (FIG. 6). The motor compartment 35 accommodates a motor, in the form of an internal combustion engine, as well as a storage bin, a fuel tank, an air box, an electrical system (battery, electronic control unit, etc.), a resonator and other elements required or desirable in the personal watercraft 30. The motor drives a water jet propulsion system 38 (FIG. 6) of the personal watercraft 30, although other types of propulsion systems are contemplated in other implementations.

Still referring to FIGS. 1 to 7, the hull 32 defines part of an intake ramp 40 (FIG. 6) extending from an inlet 42 to a jet pump 43 of the jet propulsion system 38. The intake ramp 40 allows passage of water from underneath the hull 32, through the inlet 42 defined on the bottom of the hull 32, and into the jet pump 43. The jet pump 43 is located in a formation in the hull 32, referred to as the tunnel 41 (FIG. 1). The tunnel 41 is defined at the front, sides, and top by the hull 32 and is open at the transom 44. The bottom of the tunnel 41 is closed by a ride plate 45. The ride plate 45 creates a surface on which the personal watercraft 30 rides or planes at high speeds.

The jet pump 43 includes an impeller 46 and a stator 48 (FIG. 6). The impeller 46 is coupled to the motor by one or more shafts 50, such as a driveshaft and an impeller shaft. The rotation of the impeller 46 pressurizes the water, which then moves over the stator 48 that is made of a plurality of fixed stator blades (not shown). The role of the stator blades is to decrease the rotational motion of the water so that almost all the energy given to the water is used for thrust, as opposed to swirling the water. Once the water leaves the jet pump 43, it goes through a venturi 52. Since the venturi's 52 exit diameter is smaller than its entrance diameter, the water is accelerated further, thereby providing more thrust. A steering nozzle 54 is pivotally attached to the venturi 52 so as to pivot about a vertical axis (not shown). The steering nozzle 54 could also be supported at the exit of the tunnel 41 in other ways without a direct connection to the venturi 52. Moreover, the steering nozzle 54 can be replaced by a rudder or other diverting mechanism disposed at the exit of the tunnel 41 to selectively direct the thrust generated by the water jet propulsion system 38 to effect turning. The steering nozzle 54 is operatively connected to a helm assembly 60 (FIG. 1) preferably via a push-pull cable (not shown) such that when the helm assembly 60 is turned, the steering nozzle 54 pivots. This movement redirects the pressurized water coming from the venturi 52, so as to redirect the thrust and steer the personal watercraft 30 in the desired direction.

Referring to FIGS. 1 to 5, towards the bow 36, the deck 34 has a hood 62 including the helm assembly 60 and an instrument cluster 64. A hinge (not shown) is attached between a forward portion of the hood 62 and the front of the deck 34 to allow the hood 62 to move to an open position to provide access to the storage bin (not shown). A latch (not shown) located at a rearward portion of the hood 62 locks the hood 62 into a closed position. When in the closed position, the hood 62 prevents water from entering the storage bin. Left and right rear view mirrors 66*a*, 66*b* are positioned on corresponding left and right sides of the hood 62 to allow the operator to see behind the watercraft 30.

Still referring to FIGS. 1 to 5, the deck 34 has a centrally positioned straddle-type seat 70 supported on top of a pedestal 72 formed by the deck 34. Accordingly, the seat 70 and the pedestal 72 are aligned with the longitudinal centerline 39. The seat 70 accommodates up to three riders in a straddling position. The seat 70 has a front seat portion 74 and rear seat portion 76 made as cushioned or padded units. The front seat portion 74 has a front base 78 (FIG. 4) and the rear seat portion 76 has a rear base 80. The front base 78 and the rear base 80 are interfitting and are removably connected to the deck 34. Grab handles 81*a*, 81*b* are provided on either side of the rear base 80 to provide handholds onto which the rearmost passenger may hold.

Figure 5:
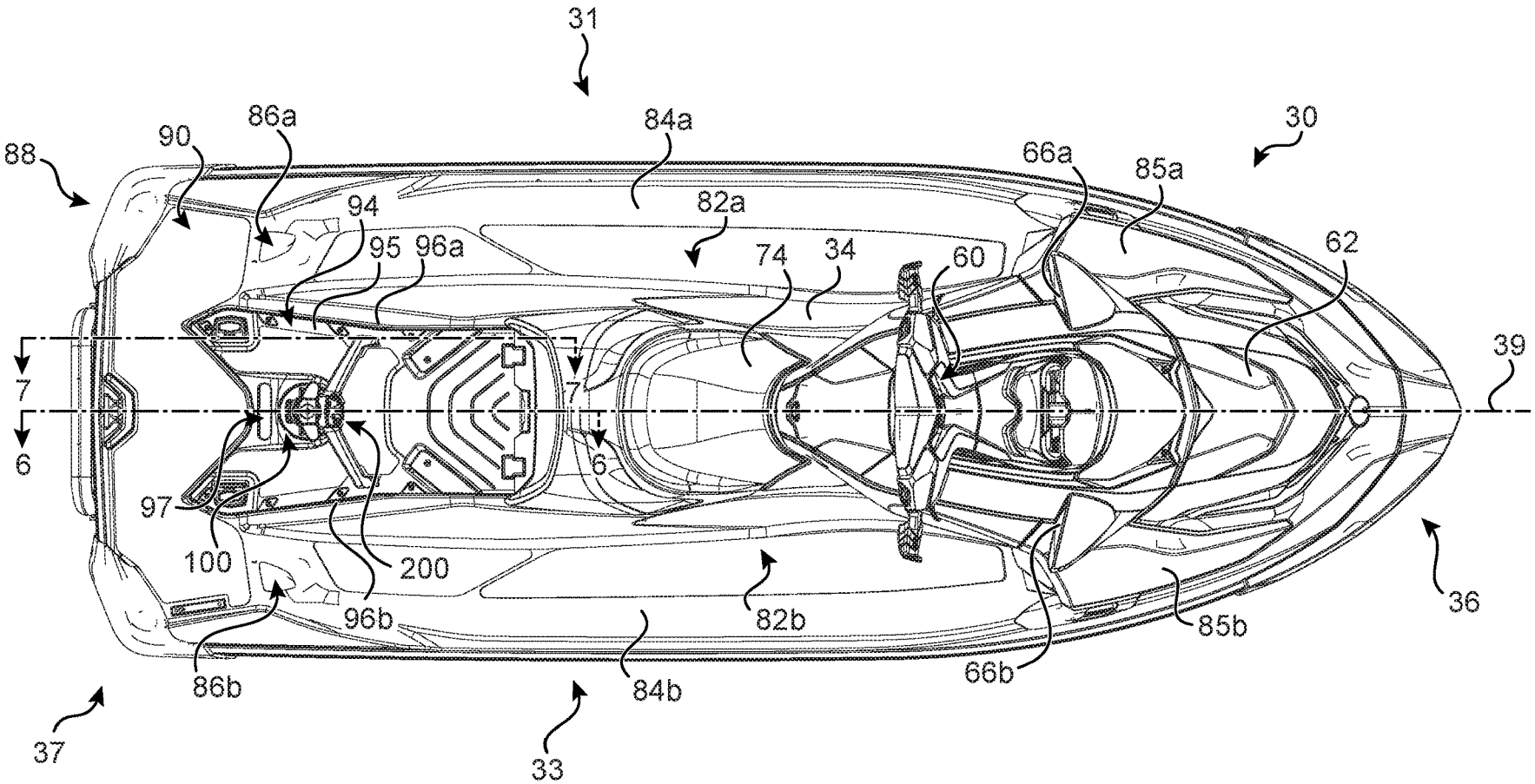
FIG. 5 is a top plan view of the personal watercraft of FIG. 4.

On the left and right sides of the pedestal 72, the deck 34 forms footwells 82*a*, 82*b* (FIG. 5) that provide support for the riders' feet. Along the footwells 82*a*, 82*b*, the watercraft 30 has a pair of generally upwardly extending walls located on either side of the watercraft 30 known as gunwales or gunnels 84*a*, 84*b*. The gunnels 84*a*, 84*b* help to prevent the entry of water in the footwells 82*a*, 82*b* of the watercraft 30, provide lateral support for the riders' feet, and also provide buoyancy when turning the watercraft 30, since the personal watercraft 30 can roll slightly when turning. Towards the bow 36, fairings 85*a*, 85*b* extend between the gunnels 84*a*, 84*b* and the hood 62 and further prevent the entry of water in the footwells 82*a*, 82*b*. Towards the stern 37, the gunnels 84*a*, 84*b* extend inwardly to act as heel rests 86*a*, 86*b* (FIG. 5). A passenger riding the watercraft 30 and sitting on the rear seat portion 76 facing rearwardly may place his or her heels on the heel rests 86*a*, 86*b*, thereby providing a more stable riding position when acting as spotter for a skier, tuber or the like. It is contemplated that the heel rests 86*a*, 86*b* could also be formed separately from the gunnels 84*a*, 84*b*.

Still referring to FIGS. 1 to 5, forward of a rear end 88 of the deck 34, the deck 34 includes a reboarding platform 90 allowing a rider to easily reboard the watercraft 30 from the water. The reboarding platform 90 extends longitudinally between the transom 44 of the personal watercraft 30 and the heel rests 86*a*, 86*b*. The reboarding platform 90 extends laterally over a width of the deck 34, between the left and right sides 31, 33 of the deck 34. As best seen in FIG. 1, a retractable ladder or reboarding step 92 is affixed to the transom 44 to facilitate boarding of the personal watercraft 30 from the water onto the reboarding platform 90. An anchor 93 is affixed to the rear of the deck 34 and may be used to attach a tow rope or to attach the personal watercraft 30 to a dock or trailer in conjunction with another anchor (not shown) at the bow 36.

Figure 2:
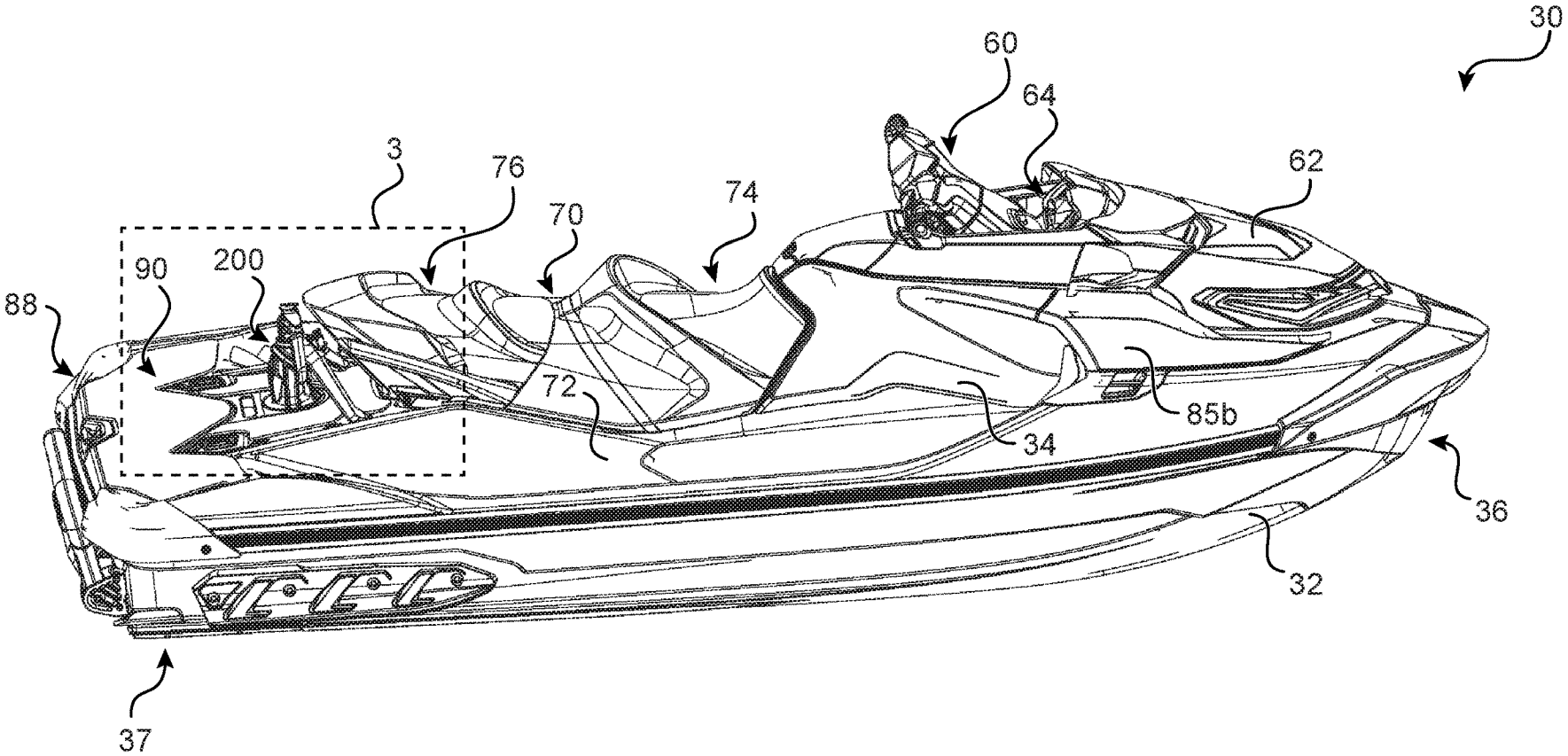
FIG. 2 is a top, right side perspective view of the personal watercraft of FIG. 1, with the pylon in a stowed position.
Figure 3:
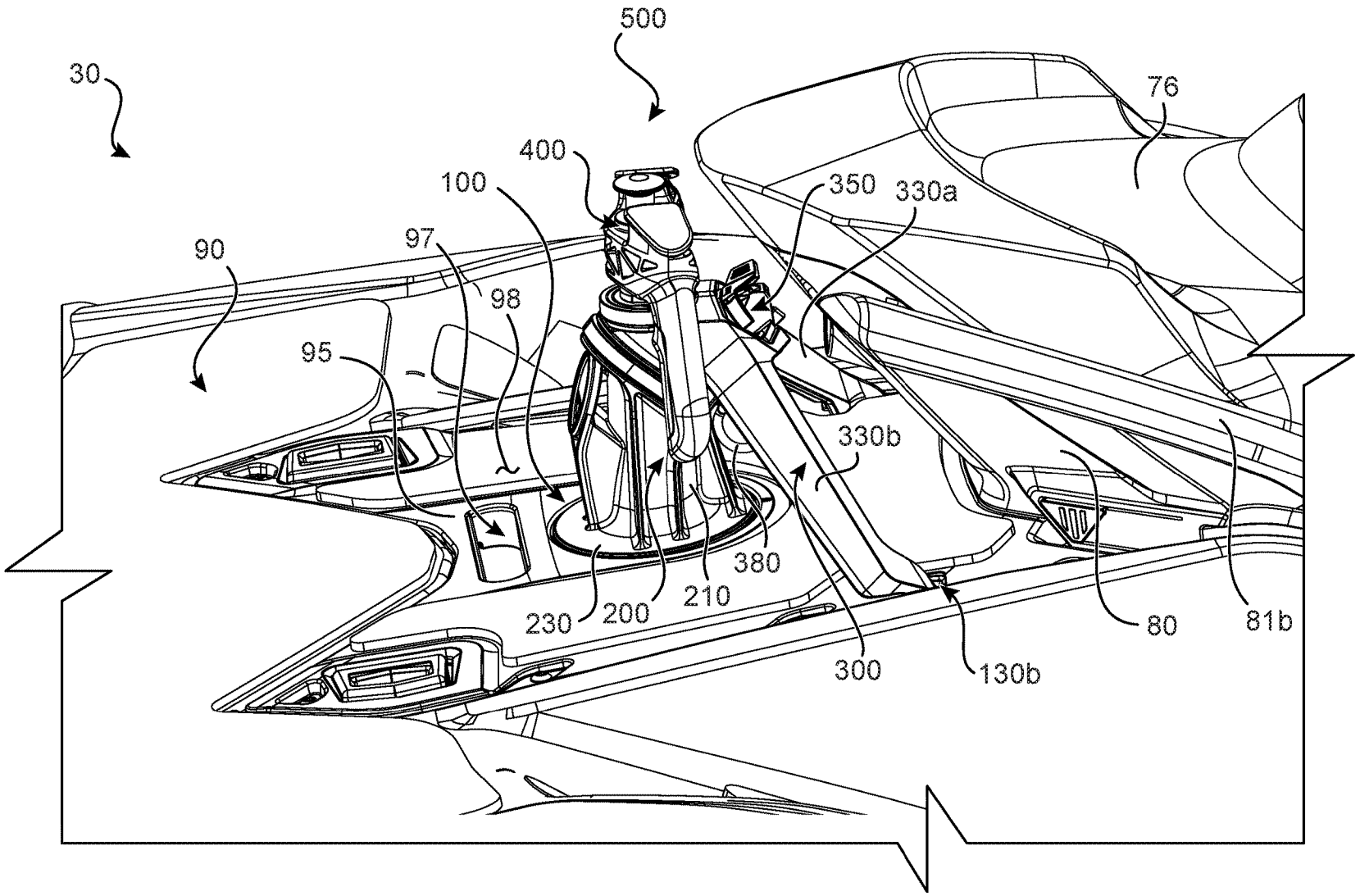
FIG. 3 is an enlarged view of portion 3 of the personal watercraft of FIG. 2.

The personal watercraft 30 has a rear platform 94 (FIGS. 1 and 4) defined by a deck panel 95 that is laterally centered on the deck 34, i.e. laterally centered along the longitudinal centerline 39 of the deck 34. The rear platform 94 extends between the footwells 82*a*, 82*b*, and forward of the reboarding platform 90. The rear platform 94 is adjacent to the reboarding platform 90. The rear platform 94 has left and right sides 96*a*, 96*b* (FIG. 1) extending forward, along an edge of pedestal 72, vertically higher than the footwells 82*a*, 82*b*. The deck panel 95 includes a recess 97 sized and shaped to form a hand hold for use in conjunction with the reboarding step 92 to facilitate boarding of the personal watercraft 30. The recess 97 is positioned along the longitudinal centerline 39, in front of the reboarding platform 90. As can be seen in FIGS. 1 to 3, the deck panel 95 defining the rear platform 94 has a top face 98 (FIG. 3). The top face 98 of the deck panel 95 has a portion which is generally coplanar with the reboarding platform 90. The term "coplanar" is to be understood in the sense that the top face 98 of the deck panel 95 and the reboarding platform 90 form a generally planar surface at the rear of the deck 34. In other words, the generally planar surface extends forward of the rear end 88 of the deck 34.

Figure 18:
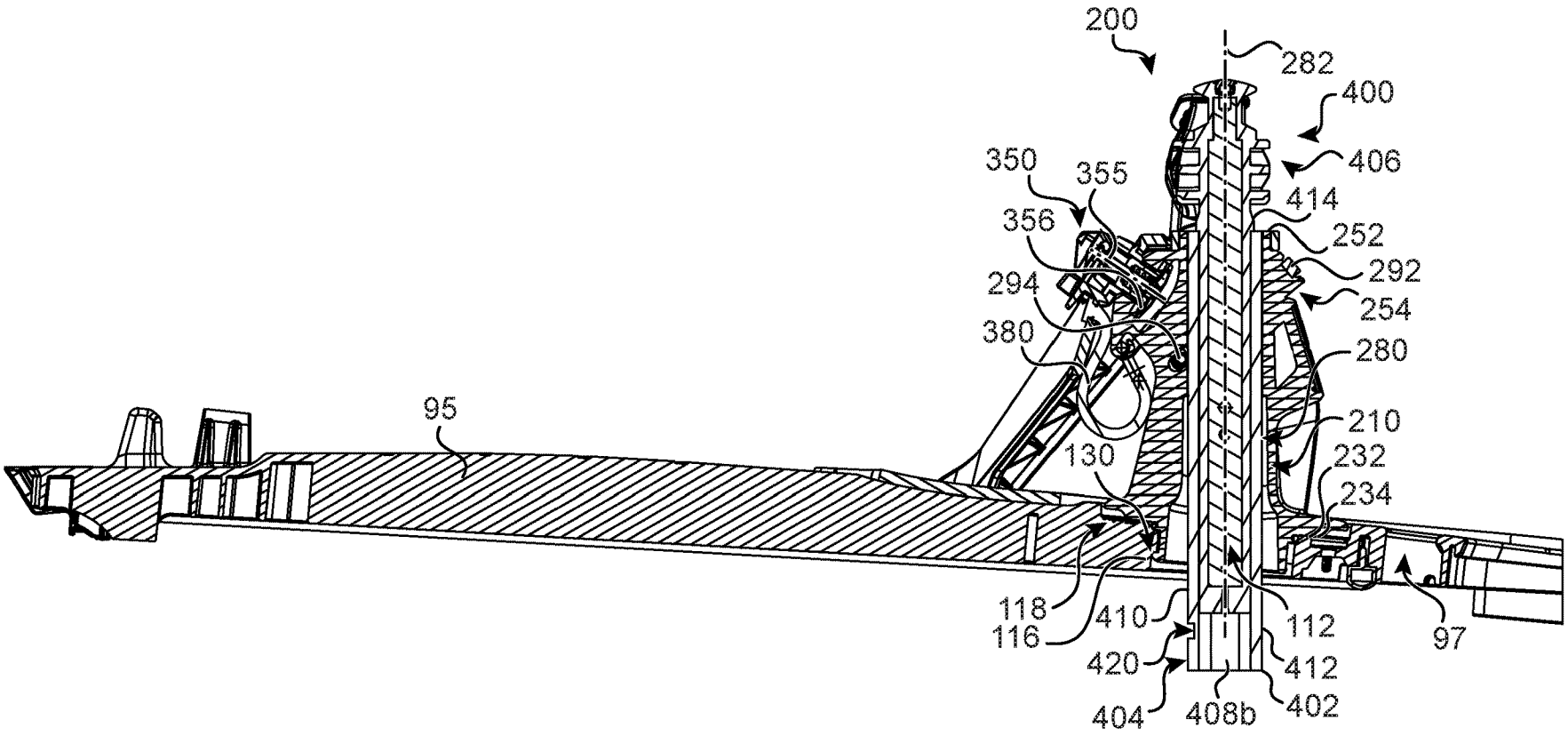
FIG. 18 is a longitudinal cross-sectional view of the deck panel, base and brace of FIG. 17.
Figure 19:
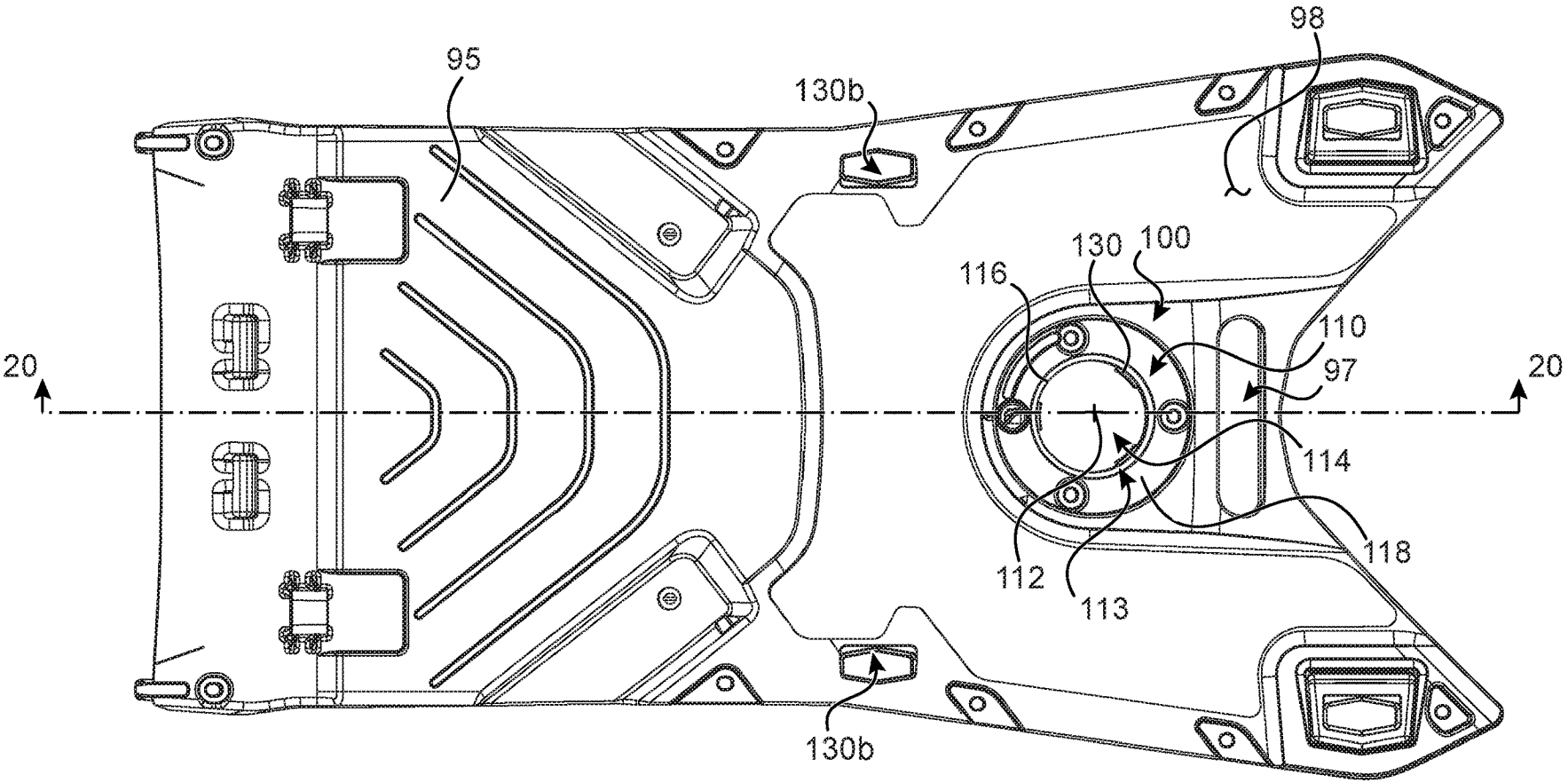
FIG. 19 is a top plan view of the deck panel of FIG. 15, with the support structure removed.
Figure 20:
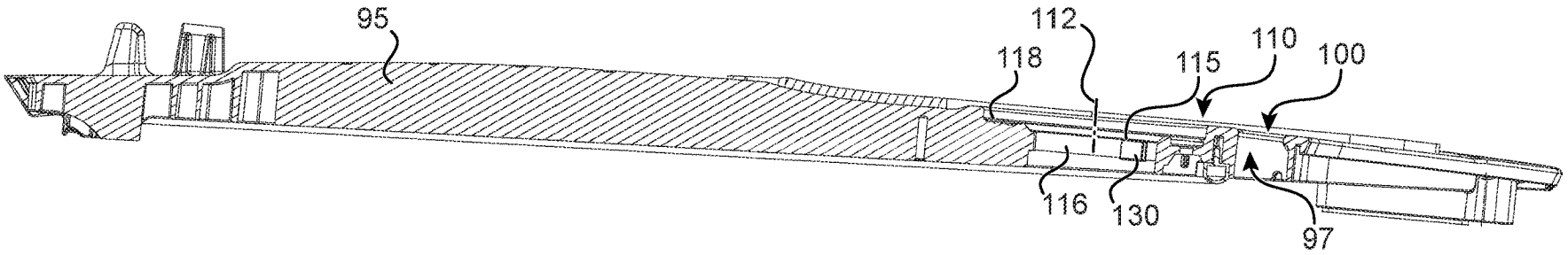
FIG. 20 is a cross-sectional view of the deck panel of FIG. 19 taken along cross-section line 20-20 of FIG. 19.

The deck panel 95 also defines a mounting surface 100 of the personal watercraft 30. The mounting surface 100 defines a base mount 110 (FIGS. 6 and 19) and two brace mounts 130*a*, 130*b* (FIG. 19). The base mount 110 is a through hole defined in the deck panel 95. The base mount 110 has its center 112 positioned along the longitudinal centerline 39, but could be positioned elsewhere in other implementations. Referring to FIGS. 18 to 20, a periphery 113 of an aperture 114 defines a top 115 of the base mount through hole. The aperture 114 is bound by a cylindrical wall 116 extending vertically below the mounting surface 100. The aperture 114 is also bound by a lip portion 118 extending parallel to and below the mounting surface 100. In some implementations, the base mount 110 could be a recess defined in the mounting surface 100, or a protrusion extending above the mounting surface 100.

Referring to FIGS. 5 to 7 and 14, the brace mounts 130*a*, 130*b* are recesses defined in the deck panel 95 on the left and right sides 31, 33 of the longitudinal centerline 39. In some implementations, each one of the brace mounts 130*a*, 130*b* could be a loop extending above the mounting surface 100, or a through hole defined in the mounting surface 100, and/or could be defined elsewhere on the mounting surface 100. The brace mount 130*a* has a downwardly-facing top surface 132*a* (FIG. 7) extending below the mounting surface 100. The brace mount 130*a* further includes a space 134*a* that is bound in an upward direction at least partially by the top surface 132*a*. Similarly, the brace mount 130*b* has a top surface (not shown) extending below the mounting surface 100. The brace mount 130*b* further includes a space (not shown) that is bound at least partially by the top surface.

Referring to FIGS. 6 to 11, a support structure 200 for mounting an accessory assembly to the personal watercraft 30 will be generally described. The support structure 200 includes a base 210 for connecting a mounting member of the accessory assembly. In the present implementation, the base 210 defines a receptacle 280 (FIG. 18) that receives the mounting member of the accessory assembly, but the base 210 could be configured otherwise as will be described below. For illustrative purposes, the accessory assembly in the present implementation is a tow pylon assembly 400 including a pylon 402 as the mounting member. It is contemplated that the accessory assembly could be, for example, a railing assembly, a rack assembly, a seat assembly having a seat post as the mounting member, a storage assembly, or a lighting mast assembly. Other types of accessory assemblies are also contemplated. It is contemplated that the same base 210 could connect different types of accessory assemblies, including, but not limited to, the examples mentioned above.

Referring to FIGS. 6 to 13, the support structure 200 further includes a brace 300 having a mating portion 310 that is engageable to the base 210. The brace 300 has left and right arms 330*a*, 330*b* extending from the mating portion 310 toward the mounting surface 100 and away from the base 210. The arms 330*a*, 330*b* have proximal ends 332*a*, 332*b* connected to the mating portion 310, and distal ends 334*a*, 334*b* that are selectively engageable in a corresponding one of the brace mounts 130*a*, 130*b*. The support structure 200 further includes a lock 350 selectively locking the mating portion 310 to the base 210 when engaged thereto.

Figure 10:
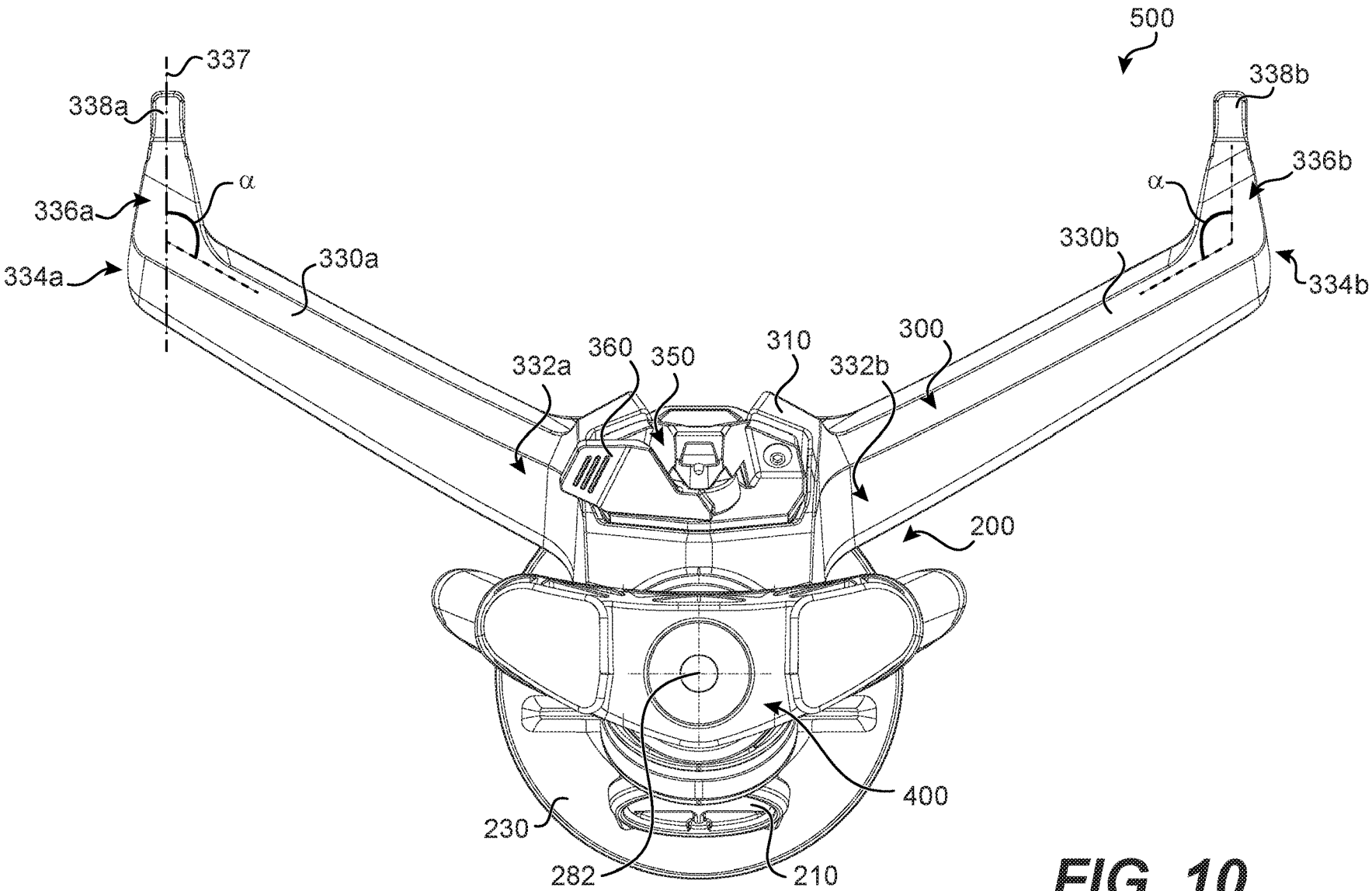
FIG. 10 is top plan view of the support structure and the tow pylon assembly of FIG. 8.
Figure 11:
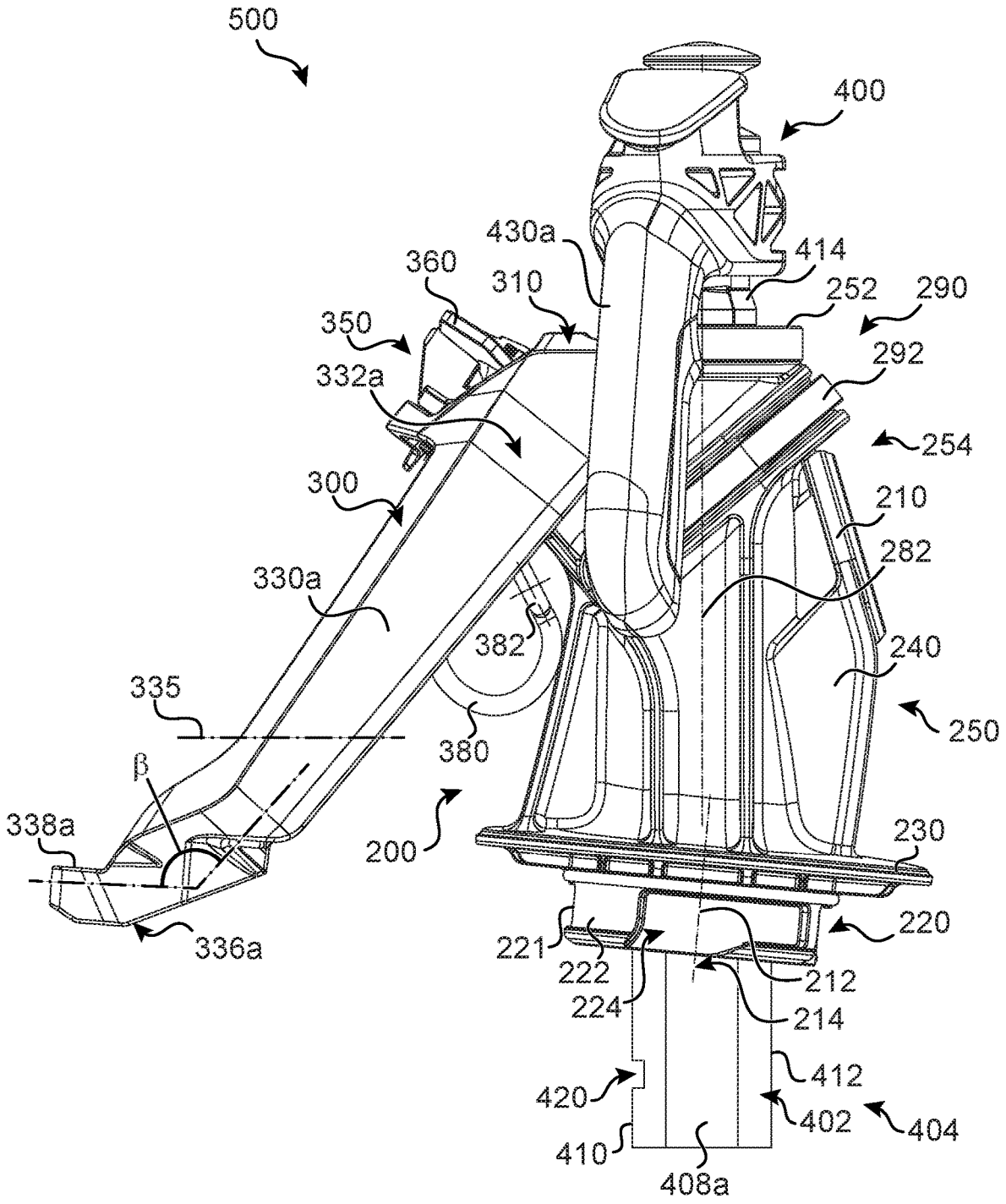
FIG. 11 is a left side elevation view of the support structure and the tow pylon assembly of FIG. 8.

Referring to FIGS. 6 to 11 and 18, the base 210 will be described in more detail. The base 210 includes a connection portion 220 and a support portion 250 (FIG. 11). The connection portion 220 includes a cylindrical wall 221 that has angularly-spaced projections 222 and angularly-spaced recesses 224 defined between the projections 222. The projections 222 extend laterally outwardly from the cylindrical wall 221 of the base 210. The projections 222 and the recesses 224 are asymmetrical with respect to a rotation axis 212 (FIG. 11) of the base 210 extending vertically at a center 214 of the connection portion 220. The cylindrical wall 116 of the base mount 110 is shaped and dimensioned to receive the cylindrical wall 221 therein. The cylindrical wall 116 of the base mount 110 has angularly-spaced projections 130 that are complementary to the recesses 224 of the connection portion 220. The asymmetry of the projections 222, 130 and of the recesses 224 limits the insertion of the connection portion 220 into the base mount 110 in a first predetermined orientation.

To selectively connect the base 210 to the mounting surface 100, the connection portion 220 is first inserted into the aperture 114 of the base mount 110 in the first predetermined orientation. The base 210 is subsequently rotated within the base mount 110. When the base 210 is rotated about the rotation axis 212 within the base mount 110, the projections 130 of the cylindrical wall 116 engage the recesses 224 of the connection portion 220, thereby selectively connecting the base 210 to the base mount 110. In the present implementation, after the connection portion 220 has been inserted into the base mount 110 in the first predetermined orientation, a clockwise rotation (when viewed from above) of about 60 degrees about the rotation axis 212 selectively connects the base 210 to the base mount 110. When selectively connected, the base 210 has a second predetermined orientation with respect to the mounting surface 100, which is shown in FIGS. 1 to 3. The second predetermined orientation is selected to ensure that the user mounts the support structure 200 to the mounting surface 100 in an orientation that is suitable for using the accessory assembly. To disconnect the connection portion 220 from the base mount 110, the base 210 is first rotated counterclockwise by about 60 degrees about the rotation axis 212, and then the base 210 is pulled vertically to be withdrawn from the base mount 110. The base 210 is thus selectively connectable to the mounting surface 100.

Other configurations of the base 210 and of the base mount 110 are contemplated. For example, in some implementations, the base mount could be a cylindrical protrusion extending vertically above the mounting surface 100, and the cylindrical protrusion could have a cylindrical outer wall having outwardly extending angularly-spaced projections and recesses defined between the projections. The connection portion of the base could include a cylindrical portion having an opened bottom, the cylindrical portion being slightly larger than the base mount and having angularly-spaced projections extending laterally inwardly from the cylindrical portion and recesses defined between the projections. The projections and recesses of the base mount and of the connection portion could be complementary shaped and dimensioned for selective connection of the base to the mounting surface upon rotation of the base with respect to the base mount, as described above. In yet another implementation, the connection portion of the base could be selectively connected to the base mount using at least one clip latch, at least one pin extending through the base mount and the connection portion, or the connection portion of the base could include at least one skewed portion engageable into at least one base mount recess, each skewed portion extending below a portion of the mounting surface adjacent to the corresponding base mount recess.

Figure 15:
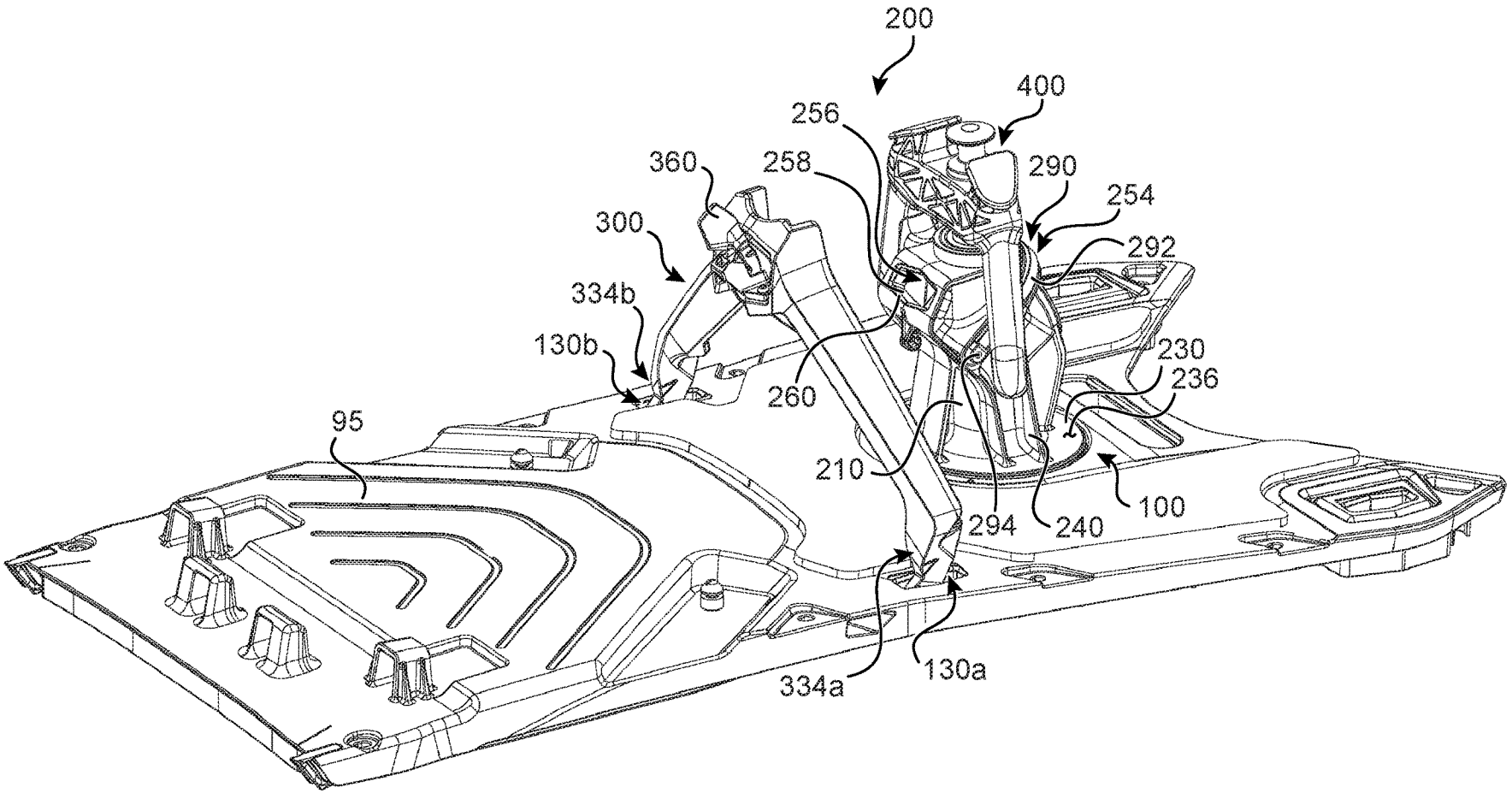
FIG. 15 is a top, left, front side perspective view of a deck panel of the personal watercraft of FIG. 14, with a base of the support structure of FIG. 8 connected thereto, and the brace of FIG. 12 being inserted into brace mounts defined in the deck panel and disengaged from the base.

Referring to FIGS. 8 to 11, the base 210 further includes a flange 230 between the connection portion 220 and the support portion 250. The flange 230 extends laterally outwardly from the base 210. With further reference to FIG. 18, a seal 232 is connected to a face 234 of the flange 230 facing toward the connection portion 220, the face 234 being the bottom face of the flange 230. When the base 210 is connected to the base mount 110, the seal 232 is compressed between the lip portion 118 of the base mount 110 and the flange 230 of the base 210 and assists in preventing water ingress in the base mount 110. As best seen in FIG. 15, a top face 236 of the flange 230 is substantially coplanar with the mounting surface 100 when the base 210 is connected to the base mount 110. The base 210 further includes structural ribs 240 extending vertically on the support portion 250.

Referring to FIG. 18, the receptacle 280 is a through hole extending through the support portion 250 and the connection portion 220, but could be a borehole extending at least partially in the support portion 250 in some implementations. The receptacle 280 is shaped and dimensioned to slidably receive the pylon 402 of the tow pylon assembly 400 between an extended position (FIG. 1) and a stowed position (FIG. 3).

Figure 4:
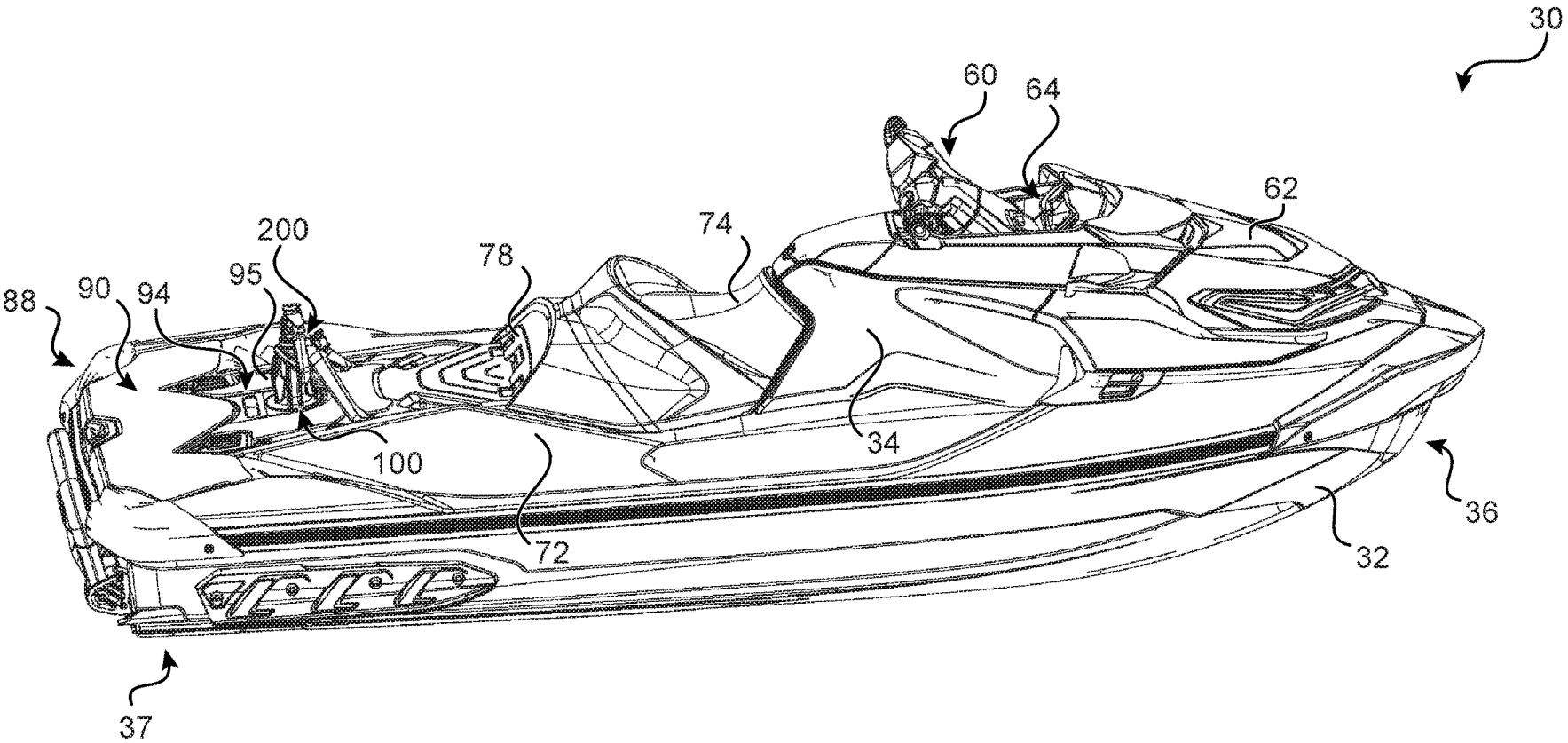
FIG. 4 is a top, right side perspective view of the personal watercraft of FIG. 2, with a rear seat portion removed.

Referring to FIGS. 8 to 11 and 18, the pylon 402 includes a tube having lower and upper portions 404, 406, flat sidewalls 408*a*, 408*b* on the left and right sides thereof, and front and rear curved walls 410, 412. The receptacle 280 has corresponding flat and curved walls. In some implementations, the receptacle 280 may include a resilient liner disposed between the pylon 402 and the walls of the receptacle 280. The resilient liner may assist in preventing water ingress within the receptacle 280, and may assist in reducing a play between the walls of the receptacle 280 and the walls 408*a*, 408*b*, 410, 412 of the pylon 402. The receptacle 280 has a central axis 282 along which the pylon 402 can be slid between the stowed position and the extended position. The central axis 282 is skewed with respect to the flange 230, but could be perpendicular thereto in some implementations. The central axis 282 is thus skewed with respect to the mounting surface 100, which is inclined between the front base 78 and the reboarding platform 90 as seen in FIG. 4. The central axis 282 is generally vertical when the base 210 is connected to the mounting surface 100. When the pylon 402 is received within the receptacle 280, the pylon 402 cannot be rotated about the central axis 282 because of the engagement of the flat sidewalls 408*a*, 408*b* of the pylon 402 with the corresponding flat sidewalls of the receptacle 280. The pylon 402 further includes a stopper 414 (FIG. 11) defined in the upper portion 406 (FIG. 18). The stopper 414 abuts on a top 252 of the support portion 250 when the pylon 402 is in the stowed position. The stopper 414 limits the insertion of the pylon 402 within the receptacle 280. As best seen in FIG. 6, when the pylon 402 is in the stowed position, the lower portion 404 of the pylon 402 extends partially through the base mount 110 and into the motor compartment 35.

Other configurations of the base 210 are contemplated. In some implementations, the receptacle 280 could be omitted and the base 210 could define a male engagement portion insertable into a female engagement portion of the mounting member of the accessory assembly and providing connection therebetween. Other features permitting attachment between the base 210 and the accessory assembly are also contemplated.

Referring to FIGS. 11 and 18, the base 210 further includes a resilient latch assembly 290 mounted to an upper portion 254 of the support portion 250. The resilient latch assembly 290 includes a resilient member 292 extending at least partially around the support portion 250, and a latch 294 (FIG. 15) selectively extending at least partially within the receptacle 280. The latch 294 is connected to the resilient member 292. A recess 420 (FIG. 11) is defined on the outer face of the front curved wall 410 of the pylon 402, in the lower portion 404 of the pylon 402. When the pylon 402 is in the extended position, the latch 294 resiliently engages the recess 420. The pylon 402 is thus locked into the extended position. In the extended position, the lower portion 404 of the pylon 402 extends in the upper portion 254 of the support portion 250. When a user pushes the pylon 402 downwardly with sufficient force to overcome the force of the resilient member 292, the latch 294 is disengaged from the recess 420 and the pylon 402 may be slid in the stowed position.

Referring to FIGS. 8 to 13, the brace 300 will be described in more detail. The brace 300 includes the mating portion 310 that is engageable to the support portion 250 of the base 210. The mating portion 310 is shaped and dimensioned to be complementary to the rear face of the upper portion 254 of the support portion 250. The brace 300 further has the two arms 330*a*, 330*b* having the proximal ends 332*a*, 332*b* integral with the mating portion 310. In some implementations, the mating portion 310 and the arms 330*a*, 330*b* could be separate components, and the proximal ends 332*a*, 332*b* could be connected to the mating portion 310 using suitable fasteners or bonding techniques known in the art. When the mating portion 310 is engaged to the support portion 250 of the base 210, the two arms 330*a*, 330*b* extend from the mating portion 310 toward the connection portion 220 of the base 210 and away from the base 210. The distal ends 334*a*, 334*b* are spaced apart from each other and from the connection portion 220. With further reference to FIGS. 3 to 5, the arms 330*a*, 330*b* extend downwardly and forwardly from the mating portion 310, and the distal ends 334*a*, 334*b* are positioned on the left and right longitudinal sides 31, 33 of the deck 34. The two arms 330*a*, 330*b* and the mating portion 310 form a V-shape, but could be configured otherwise. In some implementations, the brace 300 could have only one arm.

Figure 12:
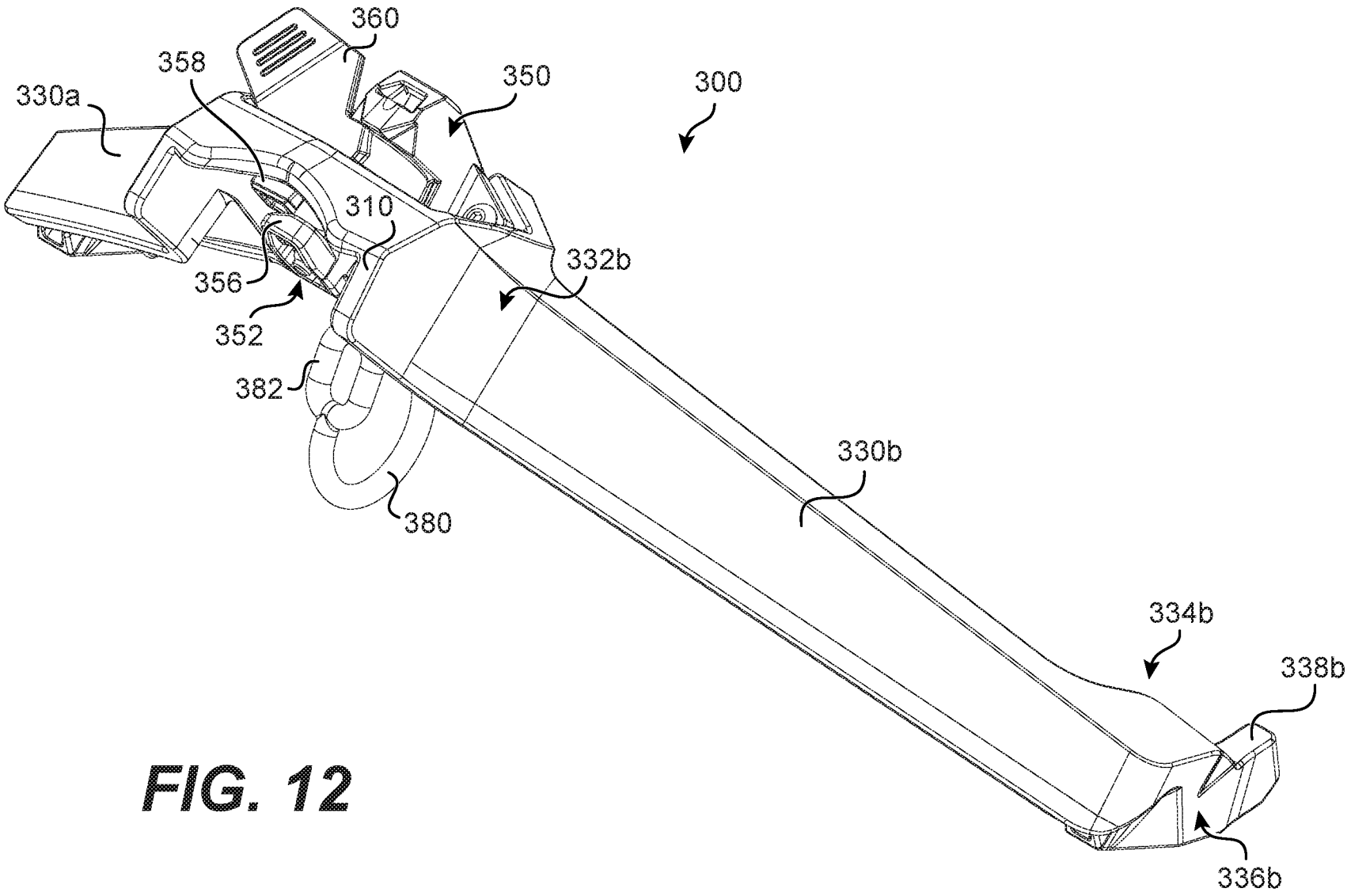
FIG. 12 is a top, right, rear side perspective view of a brace of the support structure of FIG. 8, with a lock mounted to the brace shown in a locked position.
Figure 13:
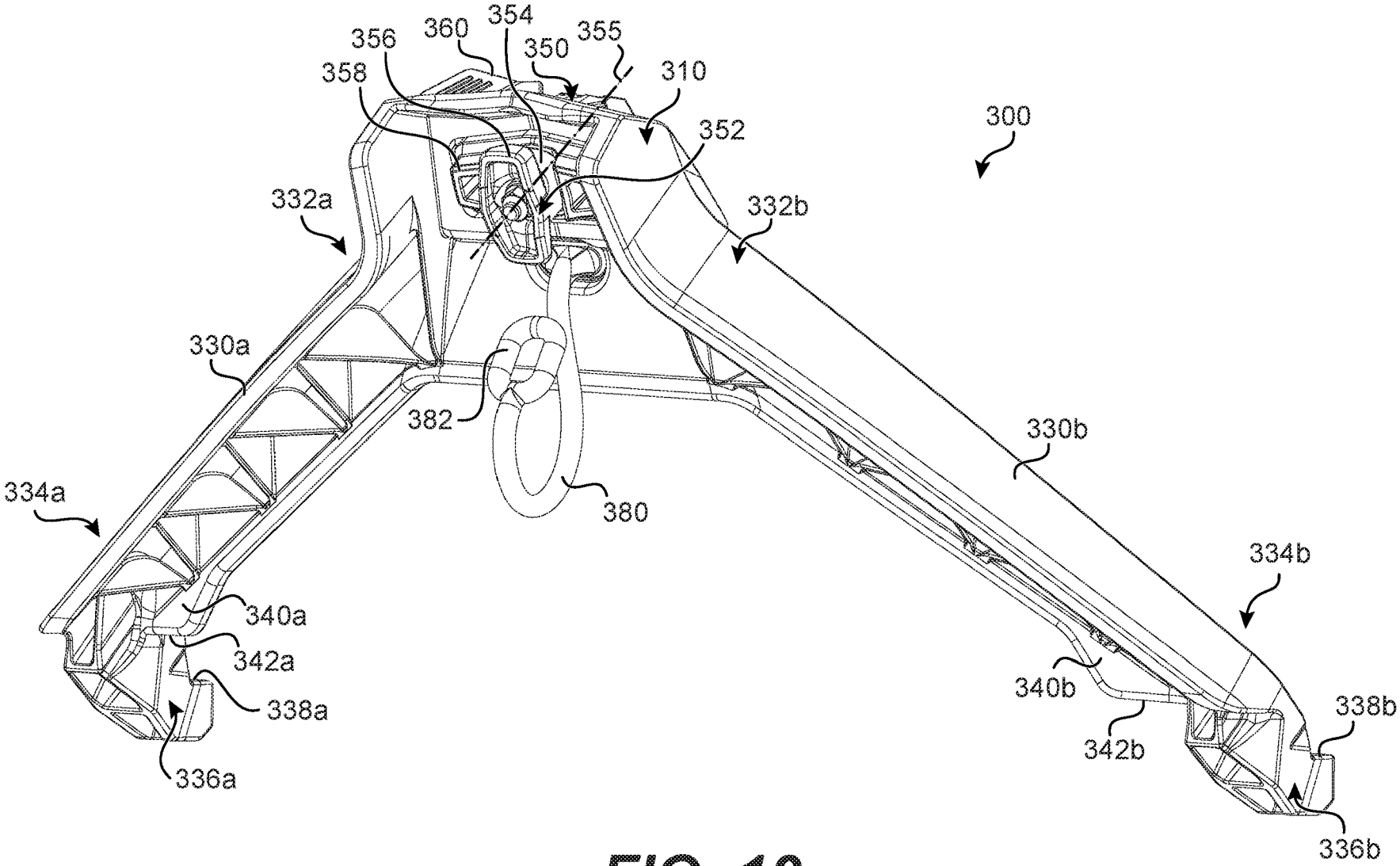
FIG. 13 is a bottom, right, rear side perspective view of the brace of FIG. 12.
Figure 17:
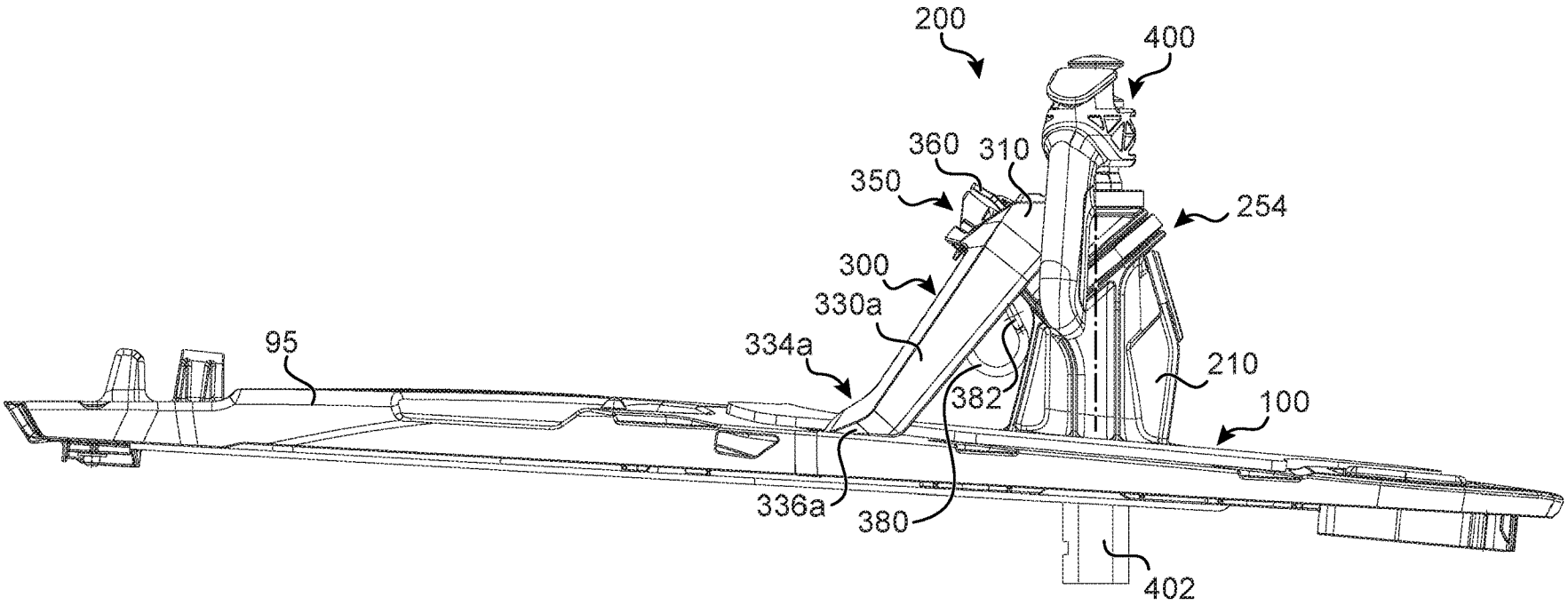
FIG. 17 is a left side elevation view of the deck panel, base and brace of FIG. 15, with the brace locked to the base.

Referring to FIGS. 7 and 10 to 13, each one of the distal ends 334*a*, 334*b* has a corresponding skewed portion 336*a*, 336*b* extending away from the base 210. The skewed portions 336*a*, 336*b* are angled with respect to the arms 330*a*, 330*b* by an angle α (FIG. 10) defined on a horizontal and longitudinal plane 335 (FIG. 11). As best seen in FIGS. 5 and 10, the arms 330*a*, 330*b* extend forwardly and laterally outwardly, and the skewed portions 336*a*, 336*b* extend forwardly and longitudinally parallel to the longitudinal centerline 39. The skewed portion 336*a*, is also angled with respect to the arm 330*a* by an angle β (FIG. 11) defined on a vertical and longitudinal plane 337 (FIG. 10). Similarly, the skewed portion 336*b* is also angled with respect to the arm 330*b* by the angle β. As best seen in FIGS. 10, 13 and 17, the arms 330*a*, 330*b* extend forwardly and downwardly toward the mounting surface 100 and the skewed portions 336*a*, 336*b* extend forwardly and parallel to the mounting surface 100.

Figure 7:
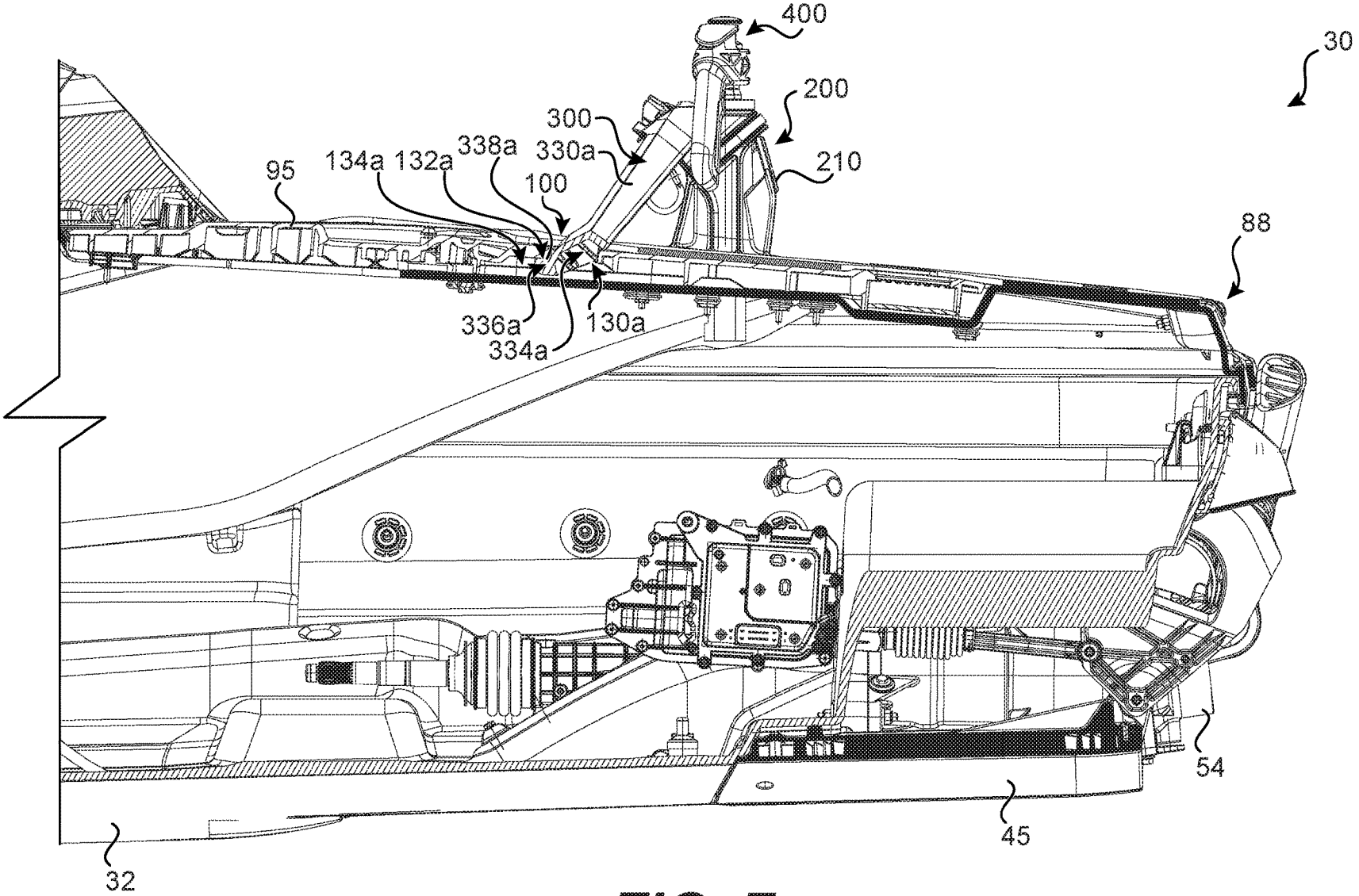
FIG. 7 is a cross-sectional view of the personal watercraft of FIG. 4 taken along cross-section line 7-7 of FIG. 5.
Figure 8:
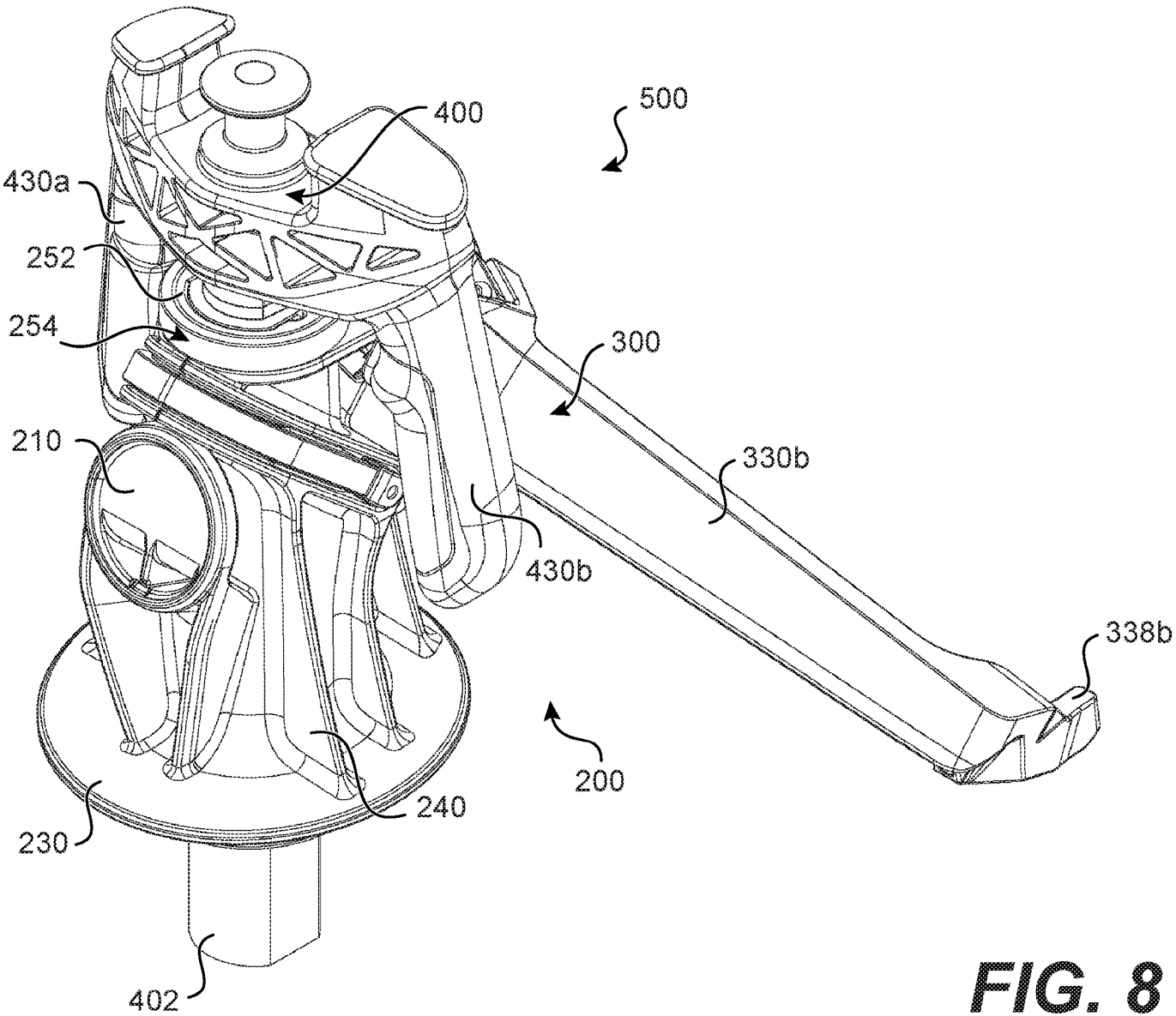
FIG. 8 is a top, right, rear side perspective view of the support structure of FIG. 1, with the pylon of the tow pylon assembly in the stowed position.
Figure 9:
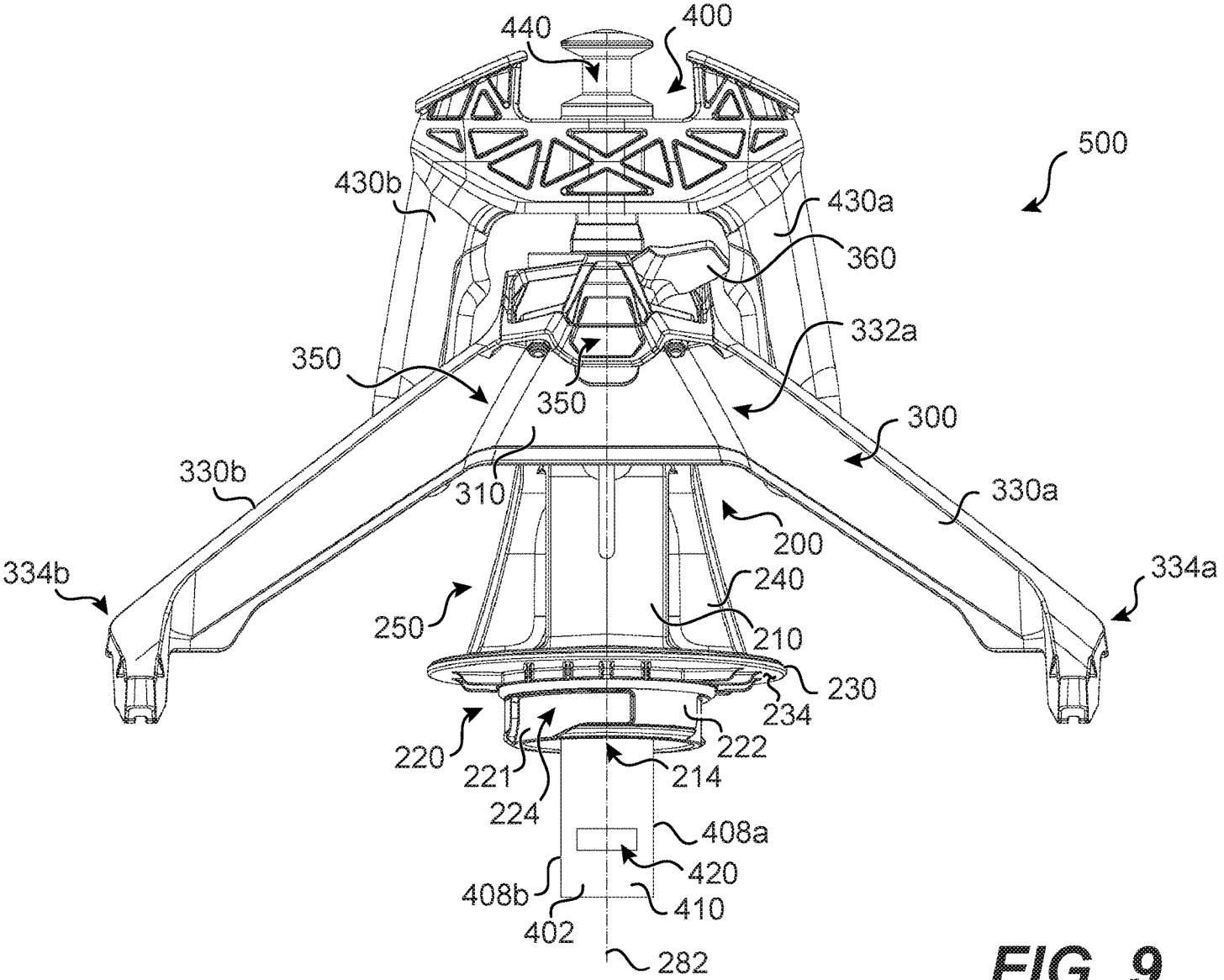
FIG. 9 is a front elevation view of the support structure and the tow pylon assembly of FIG. 8.

The distal ends 334*a*, 334*b* are simultaneously insertable into their corresponding brace mounts 130*a*, 130*b*, as seen in FIG. 15. Referring to FIGS. 7 and 10 to 13, the skewed portion 336*a* has a top face 338*a*. When the distal end 334*a* is inserted into the brace mount 130*a* and the brace 300 is pivoted rearwardly and downwardly, the skewed portion 336*a* extends at least partially in the space 134*a* and the top face 338*a* engages the top surface 132*a*, as shown in FIG. 7. As such, the skewed portion 336*a* is selectively engageable to the brace mount 130*a* when the skewed portion 336*a* extends below a portion of the mounting surface 100 adjacent the brace mount 130*a* and under the top surface 132*a*, a structure that can be referred to as a "toe-in" connection. Similarly, the skewed portion 336*b* has a top face 338*b*. When the distal end 334*b* is inserted into the brace mount 130*b* and the brace 300 is pivoted rearwardly and downwardly, the skewed portion 336*b* extends at least partially in the space and the top face 338*b* engages the top surface. As such, the skewed portion 336*b* is selectively engageable to the brace mount 130*b* when the skewed portion 336*b* extends below a portion of the mounting surface 100 adjacent the brace mount 130*b* and under the top surface thereof. The engagement of the skewed portions 336*a*, 336*b* with their corresponding brace mount 130*a*, 130*b* happens simultaneously.

Referring to FIG. 13, each one of the arms 330*a*, 330*b* includes a corresponding abutting portion 340*a*, 340*b* defined between the proximal ends 332*a*, 332*b* and the distal ends 334*a*, 334*b*. The abutting portions 340*a*, 340*b* have bottom faces 342*a*, 342*b*. When the skewed portions 336*a*, 336*b* are inserted in their corresponding brace mounts 130*a*, 130*b* and the brace 300 is pivoted rearwardly and downwardly, the bottom faces 342*a*, 342*b* of the abutting portions 340*a*, 340*b* abut on the top of the mounting surface 100 simultaneously.

Referring to FIGS. 9 to 13, the lock 350 will be described in more detail. The lock 350 is mounted to the mating portion 310 of the brace 300. In some implementations, the lock 350 could be removable from the mating portion 310. The lock 350 selectively locks the brace 300 to the base 210. A lock aperture 256 (FIG. 15) is defined in the upper portion 254 of the support portion 250. After the base 210 has been rotated into the second predetermined orientation and selectively connected to the base mount 110, the lock aperture 256 is perpendicular to the longitudinal centerline 39. The lock aperture 256 has a hexagonal shape defined by a wall 258 of the base 210 having an upper edge 260 (a lower edge not being shown). The wall 258 extends between the upper edge 260 and the lower edge.

A latch 352 of the lock 350 is selectively locked to the base 210 upon rotation of a lever 360. In the present implementation, the lock 350 is similar to the anchor described in U.S. Pat. No. 8,875,830 B2, which is incorporated by reference herein. The lock 350 could be configured otherwise. The latch 352 has a cylindrical latch body 354 (FIG. 13) that is rotatable about a latch axis 355. The lever 360 is connected to the latch body 354. The latch 352 further includes a pair of cams 356 extending perpendicularly outwardly from an end of the latch body 354 opposite to the lever 360. It is contemplated that one or more than two cams 356 could be connected to the latch body 354 depending on a shape of the lock aperture 256. The pair of cams 356 constitutes a lower flange of the lock 350. The pair of cams 356 has a hexagonal shape that is congruent with the lock aperture 256. The pair of cams 356 is rotatable about the latch axis 355 between a first position and a second position when the lever 360 is rotated. The lock 350 is a manually operable lock, which means that the lock 350 can be configured in the first and second positions upon manual operation of the lever 360 and without any tools. In the first position, the pair of cams 356 is oriented to be congruent with the lock aperture 256, making the latch 352 insertable into, and removable from the lock aperture 256. In the second position, shown in FIG. 13, the latch 352 is rotated of about 90 degrees from the first position, thus preventing the latch 352 from being removed from the base 210 when received in the lock aperture 256.

A pair of tabs 358 extends downwardly from the mating portion 310. A contour of the tabs 358 is contained within the wall 258 of the lock aperture 256 when inserted therein. A shape of the tabs 358 is congruent with the hexagonal shape of the lock aperture 256. The tabs 358 may assist in the engagement of the mating portion 310 to the support portion 250 of the base 210, and may provide additional strength to the connection between the lock 350 and the base 210. In some implementations, the tabs 358 could be omitted. After the latch 352 has been inserted into the lock aperture 256 in the first position and then rotated in the second position, the pair of cams 356 is positioned perpendicular to the lock aperture 256 and abuts on the lower edge of the wall 258, thereby selectively locking the mating portion 310 to the support portion 250 of the base 210. It is contemplated that other types of locks 350 could be employed.

Figure 16:
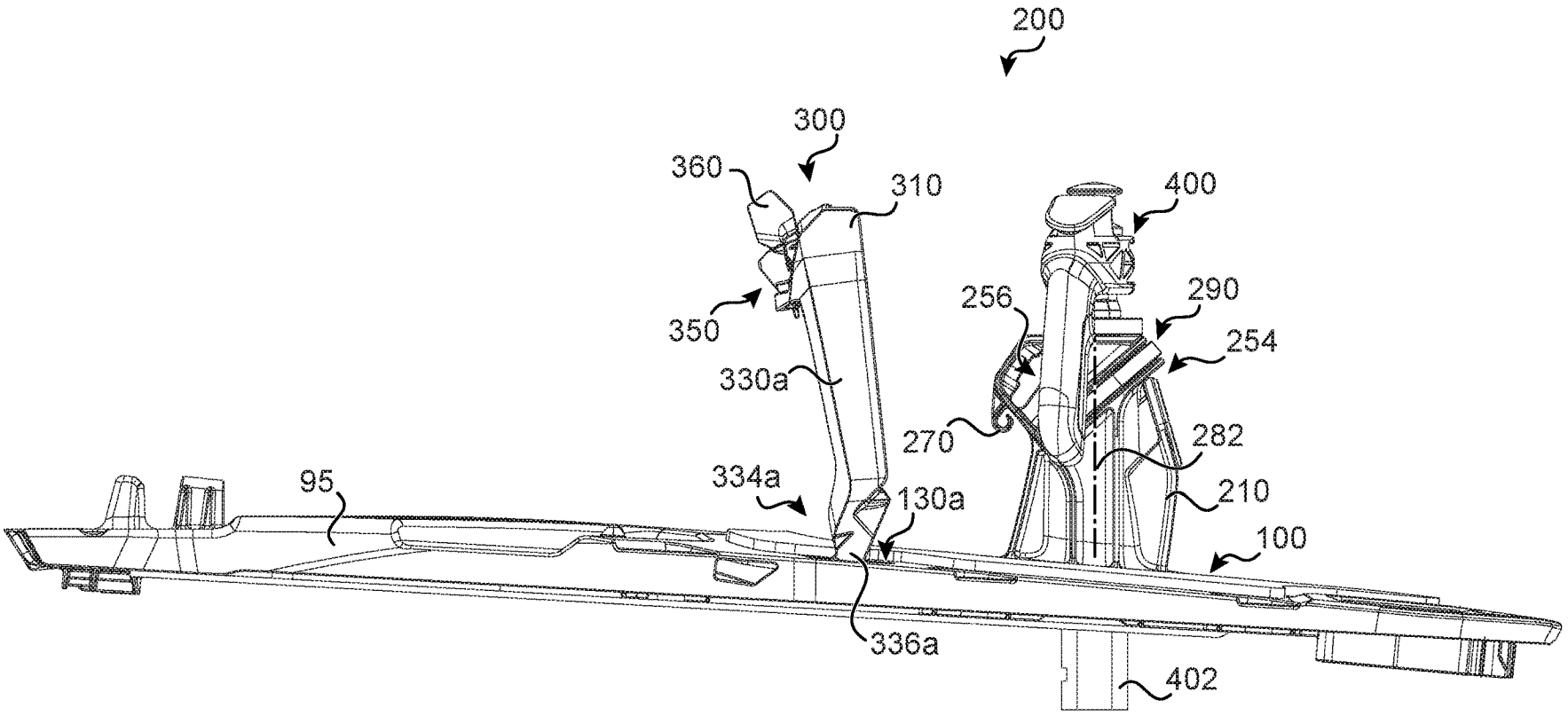
FIG. 16 is a left side elevation view of the deck panel, base and brace of FIG. 15.

Referring to FIGS. 12 and 13, a flexible elongate member 380 is connected to the brace 300, below the lock 350. The flexible elongate member 380 may be made of a resilient material, such as a silicon- or rubber-based material. The flexible elongate member 380 includes a loop 382 that is engaged by a hook 270 (FIG. 16) defined on the support portion 250 of the base 210. When the flexible elongate member 380 is connected between the brace 300 and the base 210, the brace 300 and the base 210 can be handled as a single unit when disconnected from the mounting surface 100 and when disconnected from each other by the lock 350. In addition, the flexible elongate member 380 enables the brace 300 and the base 210 to remain attached while allowing relative movement therebetween, such as when connecting or disconnecting the support structure 200 to or from the mounting surface 100.

Figure 14:
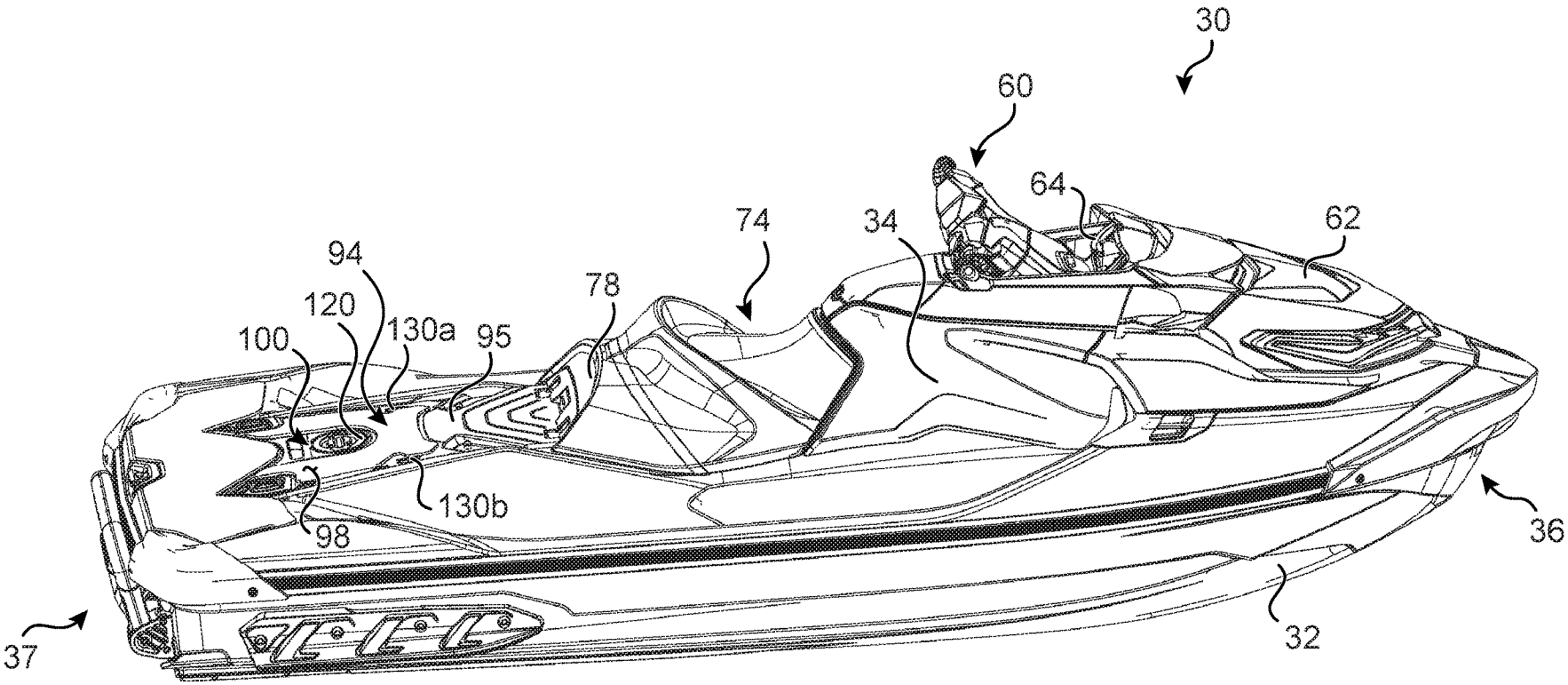
FIG. 14 is a top, right side perspective view of the personal watercraft of FIG. 4, with the support structure of FIG. 8 removed.

With reference to FIGS. 14 to 18, an illustrative scenario describing how the support structure 200 is connected to the mounting surface 100 is now provided. In this scenario, the tow pylon assembly 400 is already mounted to the support structure 200, thus defining an accessory mounting assembly 500 as shown in FIGS. 8 to 11. The base mount 110 is initially covered by a cap 120 and the rear seat portion 76 has been removed from the deck panel 95, as shown in FIG. 14. The cap 120 is generally coplanar with the mounting surface 100, but could extend above or below the mounting surface 100 in some implementations. The cap 120 has similar projections and recesses (not shown) as the ones defined in the connection portion 220 of the base 210, thus providing for selective connection of the cap 120 to the base mount 110 upon rotation of the cap 120. It is contemplated that in implementations other than the illustrated implementation, such as implementations including a differently shaped seat, a differently positioned support structure or a differently oriented support structure, the removal of a rear seat portion 76 from the deck panel 95 would not be necessary.

First, the cap 120 is removed from the mounting surface 100, leaving the aperture 114 (FIG. 19) of the base mount 110 exposed. The base 210 is then inserted into the base mount 110 in the first predetermined orientation, and rotated clockwise of about 60 degrees in the second predetermined orientation, as described above, for connection thereto. Next and referring to FIGS. 15 and 16, the skewed portions 336*a*, 336*b* of the brace 300 are inserted into the brace mounts 130*a*, 130*b*. If not already in this position, the lever 360 is manually rotated into the first position. Then, the brace 300 is pivoted rearwardly and downwardly about the skewed portions 336*a*, 336*b*. By doing so, and referring to FIGS. 7 and 17, the mating portion 310 engages the support portion 250 of the base 210, the latch 352 and the tabs 358 are inserted into the lock aperture 256, the top faces 338*a*, 338*b* engage the top surface 132*a* of the brace mount 130*a* and the top surface of the brace mount 130*b*, and the bottom faces 342*a*, 342*b* of the abutting portions 340*a*, 340*b* abut the mounting surface 100. The lever 360 is then manually rotated into the second position and the latch 352 is rotated into the lock aperture 256, thereby locking the brace 300 to the base 210. When the brace 300 is locked to the base 210 using the lock 350, as shown in FIG. 17, the mating portion 310 is vertically spaced from the mounting surface 100, and the skewed portions 336*a*, 336*b* cannot be disengaged from their corresponding brace mount 130*a*, 130*b* when pulled upwardly because of the engagement of the top faces 338*a*, 338*b* of the skewed portions 336*a*, 336*b* with the top surface 132*a* of the brace mount 130*a* and the top surface of the brace mount 130*b*. In addition, the brace 300 cannot be rotated about a vertical axis because of the engagement of the distal ends 330*a*, 330*b* to the brace mounts 130*a*, 130*b* and the lock 350 locking the brace 300 to the base 210. If needed, the rear seat portion 76 can be connected back to the deck panel 95.

Once the support structure 200 is connected to the mounting surface 100, the tow pylon assembly 400 can be used. When needed, the pylon 402 is pulled upwardly until the latch 294 resiliently engages the recess 420 and locks the pylon 402 into the extended position. A user sitting on the rear seat portion 76 facing rearwardly and acting as a spotter for a skier, a tuber, a wakeboarder or the like may hold on to handles 430*a*, 430*b* (FIG. 9) connected to the upper portion 406 of the pylon 402. The handles 430*a*, 430*b* can also be used by the user in combination with the handles 81*a*, 81*b*. A bollard 440 is also connected to the upper portion 406 of the pylon 402. The bollard 440 is configured for attaching a tow rope to the pylon 402. When the pylon 402 is in the extended position, having the tow rope attached to the bollard 440 raises the point where the tow rope is attached to the watercraft 30 compared to using the anchor 93 affixed to rear of the deck 32.

To disconnect the support structure 200 from the mounting surface 100, the lever 360 is manually rotated into the first position, unlocking the brace 300 from the base 210. The brace 300 is pivoted upwardly and forwardly until the skewed portions 336*a*, 336*b* are pivoted by a sufficient amount to be disengaged from the brace mounts 130*a*, 130*b*. The flexible elongate member 380 is stretchable and/or has a length that is sufficient to allow sufficient upward and forward pivot of the brace 300 for removal thereof from the brace mounts 130*a*, 130*b*. The base 210 is then rotated counter-clockwise from the second predetermined orientation to the first predetermined orientation and pulled upwardly for withdrawal thereof from the base mount 110. The cap 120 can then be connected to the deck panel 95 to cover the aperture 114 of the base mount 110.

The selective connection of the support structure 200 to the mounting surface 100 can be performed without any tools, which may assist in increasing the flexibility offered to the user of the personal watercraft 30 in terms of accessory assemblies and support structures selectively connectable to the deck 34 thereof. When the support structure 200 is removed from the deck 34, the base 210 and the brace 300 can be separated, or only connected together using the elongate flexible member 280, and stored in the front storage bin of the personal watercraft 30.

Modifications and improvements to the above-described implementation of the present technology may become apparent to those skilled in the art. The foregoing description is intended to be exemplary rather than limiting. The scope of the present technology is therefore intended to be limited solely by the scope of the appended claims.

The invention claimed is:

1. A support structure for mounting an accessory assembly to a vehicle, comprising:

a base adapted for being connected to the accessory assembly, the base comprising:

a connection portion being selectively connectable to the vehicle; and a support portion;

a brace comprising:

a mating portion for engaging the support portion of the base; and at least one arm extending from the mating portion toward the connection portion of the base and away from the base when the mating portion engages the support portion of the base, the at least one arm having a proximal end connected to the mating portion, and a distal end being spaced from the connection portion of the base and being selectively engageable to the vehicle, the distal end including a skewed portion extending away from the base; and a lock selectively locking the mating portion to the support portion of the base.

2. The support structure of claim 1, wherein the base defines a receptacle extending at least partially through the support portion for receiving at least a portion of the accessory assembly therein.

3. The support structure of claim 2, wherein the receptacle is a through hole extending through the support portion and the connection portion of the base.

4. The support structure of claim 1, wherein the connection portion of the base comprises angularly-spaced projections extending outwardly from the connection portion.

5. The support structure of claim 1, wherein the at least one arm is two arms, and the distal ends of the two arms are spaced apart from each other.

6. The support structure of claim 1, further comprising a flexible elongate member connected between the brace and the base.

7. The support structure of claim 1, wherein the brace comprises the lock and the lock is mounted to the mating portion of the brace.

8. The support structure of claim 1, wherein the lock is a manually operable lock.

9. An accessory mounting assembly, comprising:

a support structure comprising:

a base having a connection portion and a support portion;

a brace comprising:

a mating portion for engaging the support portion of the base; and at least one arm extending from the mating portion toward the connection portion of the base and away from the base when the mating portion engages the support portion of the base, the at least one arm having a proximal end connected to the mating portion, and a distal end being spaced from the connection portion of the base, the distal end including a skewed portion extending away from the base; and a lock selectively locking the mating portion to the support portion of the base; and an accessory assembly comprising a mounting member being connected to the base.

10. The accessory mounting assembly of claim 9, wherein:

the base defines a receptacle extending at least partially through the support portion; and the mounting member is received in the receptacle.

11. The accessory mounting assembly of claim 10, wherein the accessory assembly is a tow pylon assembly having a pylon, and the mounting member is the pylon.

12. The accessory mounting assembly of claim 11, wherein:

the base further comprises a resilient latch assembly;

the resilient latch assembly comprises a latch selectively extending at least partially in the receptacle;

the pylon comprises a recess defined on an outer face thereof; and the latch resiliently engages the recess when the pylon is in the extended position.

13. A vehicle comprising:

a mounting surface defining a base mount and at least one brace mount; and a support structure selectively connected to the mounting surface for mounting an accessory assembly to the vehicle, the support structure comprising:

a base for connecting the accessory assembly and being selectively connected to the base mount;

a brace comprising:

a mating portion being spaced from the mounting surface; and at least one arm extending away from the mating portion toward the mounting surface, the at least one arm having a proximal end connected to the mating portion, and a distal end being spaced from the base and being selectively engaged to the at least one brace mount; and a lock selectively locking the mating portion to the base.

14. The vehicle of claim 13, wherein the base mount defines an aperture.

15. The vehicle of claim 14, wherein the aperture is bound by a cylindrical wall extending vertically from the mounting surface, and a connection portion of the base is received within the aperture and the cylindrical wall of the base mount.

16. The vehicle of claim 13, wherein the at least one brace mount is one of at least one brace mount recess, and at least one brace mount through hole.

17. The vehicle of claim 16, wherein:

the brace mount has a top surface extending below the mounting surface, and the brace mount defines a space extending at least partially under the top surface; and the distal end of the at least one arm comprises a skewed portion that extends in the space below a portion of the mounting surface adjacent to the at least one brace mount, and under the top surface of the brace mount.

18. The vehicle of claim 13, wherein the base mount and the base comprise complementary angularly-spaced projections and angularly-spaced recesses for selectively connecting the base to the mounting surface upon rotation of the base with respect to the base mount.

19. The vehicle of claim 13, further comprising a deck having a longitudinal centerline, the deck defining the mounting surface, wherein:

the base mount is defined along the longitudinal centerline;

the at least one brace mount is two brace mounts defined on the deck forward of the base mount and on either side of the longitudinal centerline;

the at least one arm is two arms extending on either side of the longitudinal centerline and forward of the base; and the distal end of each of the two arms is selectively engaged with a corresponding one of the two brace mounts.

20. The vehicle of claim 13, wherein the vehicle is a personal watercraft.

* * * * *